US011105036B2

(12) United States Patent
Chae et al.

(10) Patent No.: US 11,105,036 B2
(45) Date of Patent: Aug. 31, 2021

(54) CLOTHES PROCESSING APPARATUS AND CONTROL METHOD THEREFOR

(71) Applicant: LG ELECTRONICS INC., Seoul (KR)

(72) Inventors: Aekyung Chae, Seoul (KR); Oshin Kwon, Seoul (KR); Keunjoo Kim, Seoul (KR); Jaeyong Jeong, Seoul (KR); Dongsoo Lee, Seoul (KR); Hoil Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 95 days.

(21) Appl. No.: 16/611,731

(22) PCT Filed: Jul. 4, 2018

(86) PCT No.: PCT/KR2018/007573
§ 371 (c)(1),
(2) Date: Nov. 7, 2019

(87) PCT Pub. No.: WO2019/009615
PCT Pub. Date: Jan. 10, 2019

(65) Prior Publication Data

US 2020/0102691 A1 Apr. 2, 2020

(30) Foreign Application Priority Data

Jul. 4, 2017 (KR) ..... 10-2017-0084685

(51) Int. Cl.
*D06F 39/08* (2006.01)
*D06F 21/06* (2006.01)
(Continued)

(52) U.S. Cl.
CPC ..... *D06F 39/087* (2013.01); *D06F 21/06* (2013.01); *D06F 29/00* (2013.01); *D06F 33/00* (2013.01)

(58) Field of Classification Search
CPC ..... D06F 39/087
See application file for complete search history.

(56) References Cited

U.S. PATENT DOCUMENTS

2015/0184326 A1 7/2015 Seo et al.
2016/0201243 A1 7/2016 Bergamo et al.

FOREIGN PATENT DOCUMENTS

CN 102899849 A 1/2013
CN 106637801 A 5/2017
(Continued)

OTHER PUBLICATIONS

PCT International Search Report for corresponding International Application No. PCT/KR2018/007573, dated Nov. 1, 2018 (18 pages).
(Continued)

*Primary Examiner* — Jason Y Ko
(74) *Attorney, Agent, or Firm* — Finnegan, Henderson, Farabow, Garrett & Dunner LLP

(57) ABSTRACT

A laundry treating apparatus is disclosed. The laundry treating apparatus comprises a tub provided to hold wash water; a drum rotatably provided in the tub and comprising a shaft which is perpendicular with the ground; a sub-drum detachably mounted to an inner circumferential surface of the drum and configured to wash laundry, independent from the drum; a tub cover provided in an upper surface of the tub and comprising a laundry introduction opening formed therein; a sensing object unit provided in the sub-drum; and a sensor unit provided in the tub cover and configured to sense the sensing object unit.

20 Claims, 10 Drawing Sheets

(51) Int. Cl.
*D06F 29/00* (2006.01)
*D06F 33/00* (2020.01)

(56) References Cited

FOREIGN PATENT DOCUMENTS

| | | | |
|---|---|---|---|
| JP | 2002-292192 | A | 10/2002 |
| JP | 2008-253473 | A | 10/2008 |
| JP | 2013-013659 | A | 1/2013 |
| JP | 2016-154641 | A | 9/2016 |
| KR | 10-0539506 | B1 | 2/2006 |
| KR | 10-2015-0077059 | A | 7/2015 |
| KR | 10-2015-0106680 | A | 9/2015 |
| KR | 10-2016-0127681 | A | 11/2016 |
| WO | WO 2018/038399 | A1 | 3/2018 |

OTHER PUBLICATIONS

IP Australia Office Action for Australian Application No. 2018296986 dated Jun. 29, 2020 (10 pages).
Intellectual Property India Examination Report for Indian Application No. 201917045315 dated Nov. 4, 2020 (5 pages).
Office Action, Chinese Application No. 201880045008.6, dated Mar. 23, 2021, 23 pages (including translation).

CLOTHES PROCESSING APPARATUS AND CONTROL METHOD THEREFOR

CROSS-REFERENCE TO RELATED APPLICATIONS

This application is a National Phase of PCT International Application No. PCT/KR2018/007573 filed on Jul. 4, 2018, which claims the benefit of priority under 35 U.S.C. § 119(a) to Korean Patent Application No. 10-2017-0084685, filed on Jul. 4, 2017, the contents of all of which are hereby incorporated by reference in their entireties.

FIELD

Embodiments of the present disclosure relate to a laundry treating apparatus and a control method of the same, more particularly, to a laundry treating apparatus which includes a sub-drum additionally mounted in a drum so as to perform laundry-treating in both of the drum and sub-drum.

BACKGROUND

Generally, a laundry treating apparatus includes a washer configured to perform washing, a dryer configured to perform drying and a laundry machine with washing and drying functions configured to perform both washing and drying.

Such a laundry treating apparatus is used as the washer may include a cabinet defining an external appearance; a tub mounted in the cabinet and configured to hold wash water; a drum rotatably provided in the tub and configured to wash clothes or laundry; and a door coupled to the door and provided to facilitate the loading and unloading of the clothes or laundry.

The laundry treating apparatus may be classified into a top loading type having a drum shaft which vertically stands with respect to a reference plane (e.g., the ground) and a front loading type having the drum shaft which is horizontally arranged in parallel with the ground.

In the front type laundry treating apparatus, the drum shaft is substantially parallel with the ground, and washing is performed by using a frictional force between the laundry, the drum rotated by the drive force of a motor and the drop impact of the laundry, in a state where detergent, wash water and laundry are loaded in the drum. Such a drum washing method yields little damage on the laundry and little laundry entangling, while having a washing effect like hand-rubbing-and-striking.

In the top loading type laundry apparatus, the drum shaft is substantially vertical with respect to the ground and the drum is mounted in the tub where wash water is held. The washing is performed in a state where the laundry is submerged in the wash water supplied to the drum and the top loading drum laundry apparatus is categorized into a pulsator type and an agitator type. The pulsator type includes a pulsator which is rotatably oriented in a bottom of the drum configured to accommodate wash water and laundry and rotates the wash water and the laundry by rotating the pulsator so as to perform the washing. The agitator type includes an agitator which is projected from the bottom of the drum upwardly and rotates the wash water and the laundry by rotating the agitator so as to perform the washing.

The top loading type laundry treating apparatus is configured to perform the washing by using both the friction between the wash water and the laundry and the chemical action of the detergent which are facilitated by the rotation of the drum or the agitator or pulsator which is provided in the bottom of the drum to create water currents. Accordingly, enough wash water has to be supplied to submerge the laundry to perform the washing in the top loading type laundry treating apparatus and the top loading type laundry treating apparatus requires much wash water.

In the conventional laundry treating apparatus, a washing course, more specifically, the washing course configured of a wash cycle, a rinse cycle and a dry-spin cycle may be performed in one drum. If the laundry has to be sorted based on fabric materials, the washing course has to be performed at least two times and more operations of the laundry treating apparatus have to be performed. Accordingly, the conventional laundry treating apparatus has some disadvantages of detergent waste and energy consumption.

To solve such disadvantages, a laundry treating apparatus further including a sub-drum detachably mounted in the drum is suggested. Such a sub-drum may accommodate water, independent from the tub, and water currents may be formed in the sub-drum by the rotation of the sub-drum so as to perform an additional washing course independently.

Washing for the main-drum and washing for the sub-drum need to be independently performed. More specifically, it is preferred that the wash water held in the main-drum is not mixed with the water held in the sub-drum. If the wash water held in the main-drum and the sub-drum is mixed, there may be a concern that the laundry becomes dyed. Also, the detergent used for the laundry in the main-drum could be different from the detergent used for the laundry in the sub-drum.

More specifically, it is preferred that the supplied water is not mixed and the drained water.

Accordingly, it is necessary to provide a laundry treating apparatus which is able to effectively facilitate such independent washing processes.

Meanwhile, the control of the laundry treating apparatus could be different according to whether the sub-drum is mounted in the main-drum. With that reason, it is required to provide a structure configured to easily mount the components for determining the presence of the sub-drum mounted in the main-drum. In addition, inner and outer surfaces of the main-drum and the sub-drum quite often contact with moisture or water. Accordingly, it is necessary to provide a structure configured to protect such components from the moisture or water.

DETAILED DESCRIPTION OF THE INVENTION

Technical Problem

To overcome the disadvantages, an object of the present disclosure is to solve the above-noted problems.

Another object of the present disclosure is to provide a laundry treating apparatus which includes a sub-drum easily mountable in a main-drum and which may independently separate the washing for the main-drum from the washing for the sub-drum. Especially, the object is to provide a laundry treating apparatus which may substantially separate water supply and water drainage from each other.

Furthermore, a further object of the present disclosure is to provide a laundry treating apparatus which may achieve a sufficient washing effect by using only the sub-drum.

Still further, a still further object is to provide a laundry treating apparatus which may allow a user to additionally load laundry in the main-drum as well as the sub-drum.

Still further, a still further object is to provide a laundry treating apparatus which may effectively discharge wash water from the sub-drum, without being drawn into the main-drum.

Still further, a still further object is to provide a laundry treating apparatus which may discharge the wash water held in the sub-drum only in a dry-spinning cycle, without discharging the wash water in a washing cycle. Especially, the laundry treating apparatus may realize the object of the water discharging structure, without an auxiliary drive unit such as a drainage pump connected with the sub-drum.

Still further, a still further object is to provide a laundry treating apparatus which may prevent water leakage to a sensor provided in a tub cover to sense the rotation of the sub-drum during the washing and which discharges the water collected in the tub cover quickly, while preventing the water from flowing back up to an outlet hole provided to discharge.

Still further, a still further object is to provide a laundry treating apparatus which may easily mount the sensor to the tub cover without an additional component provided in the tub cover, which is provided in the conventional laundry treating apparatus.

Still further, a still further object is to provide a laundry treating apparatus which may integrally form a structure configured to mount the sensor to the tub cover.

Technical Solution

To achieve these objects and other advantages and in accordance with the purpose of the embodiments, as embodied and broadly described herein, a laundry treating apparatus comprises a tub provided to hold wash water; a drum rotatably provided in the tub and comprising a shaft which is perpendicular to the ground; a sub-drum detachably mounted to an inner circumferential surface of the drum and configured to wash laundry, independent from the drum; a tub cover provided in an upper surface of the tub and comprising a laundry introduction opening formed therein; a sensing object unit provided in the sub-drum; and a sensor unit provided in the tub cover and configured to sense the sensing object unit.

When the sub-drum is mounted in the drum, an upper end of the sub-drum may be partially located higher than the tub cover.

The tub cover may be extended towards an inner area with respect to a radial direction from an upper area of the tub. The sensing object may be located in an upper area of the sub-drum, more specifically, a cover of the sub-drum.

Accordingly, the height of the sensor unit may be approximately equal to that of the sensing object unit by locating the sensor unit in the upper area of the tub cover. Also, the distance between the sensor unit and the sensing object may become small such that the sensor unit can effectively sense the sensing object.

The laundry treating apparatus may further comprise a mounting portion provided in the tub cover to mount the sensor unit therein, wherein the mounting portion is provided to surround the sensor unit to protect water from being drawn into the sensor unit.

The mounting portion may comprise an accommodating area provided in the tub cover and provided to accommodate the sensor unit. The accommodating area may be formed in a chamber shape recessed from the tub cover and the sensor unit is inserted in the chamber to be surrounded therein.

The mounting portion may further comprise an accommodating area cover rotatably provided in the tub cover and configured to selectively close the accommodating area. The accommodating area cover covers an opening formed in a top of the accommodating area to substantially seal the inside of the chamber.

The mounting portion may further comprise a hinge unit configured to rotatably connect the accommodating area cover to the tub cover. Accordingly, the hinge unit may facilitate the mounting of the sensor unit via the accommodating area cover.

The mounting portion may be integrally injection-molded with the tub cover. Accordingly, the structure and the assembling process can be simple and easy.

The hinge unit is formed between the mounting portion and the accommodating area cover, with a smaller thickness than the accommodating area cover, to be foldable. As the hinge unit is integrally formed with the mounting portion and the accommodating area cover, the assembling process may be easy. Even when the accommodating area cover is open, the accommodating area cover may not be separated and thus it is convenient to fabricate.

The hinge unit may be located in an inner area with respect to a radial direction of the tub cover, and the accommodating area cover may cover the mounting portion, as being folded towards an outer area with respect to the radial direction of the tub cover via the hinge unit. The location of such a hinge unit may facilitate the process of integrally forming the accommodating area cover and the hinge unit with the tub cover. Also, as there is no gap in the hinge unit, the water drawn into the hinge unit may be prevented effectively.

The laundry treating apparatus may further comprise a fixing unit comprising a cover hook provided in the accommodating area cover; and a hook groove provided in the accommodating area and configured to be coupled to the cover hook. It is preferred that the cover hook and the hook groove are integrally formed with the tub cover.

The cover groove may facilitate communication of the accommodating area with the outside by inserting expose the cover hook therein. In other words, the cover hook may be inserted in the hook groove from the inside of the accommodating area such that moisture may be effectively prevented from being drawn therein.

The accommodating area may be partitioned off into a sensor seating area provided to seat the sensor unit therein; and a damping area in communication with the outside via the hook groove. In other words, the accommodating area may be partitioned off into the sensor seating area and the damping area by a partition wall or rib provided in the accommodating area.

The accommodating area may comprise a blocking protrusion provided in the accommodating area to prevent water from flowing between the sensor seating area and the damping area. Accordingly, even if moisture is drawn into the accommodating area, the moisture will not be drawn into the sensor seating area.

The accommodating area cover may comprise a pair of support projections configured to support both ends of the sensor unit to prevent the movement of the sensor unit caused by the rotation of the sub-drum. The pair of the support projections may be provided in inner and outer areas with respect to the radial direction and a sensor may be located between the support projections, only to stably fix the sensor.

The laundry treating apparatus may further comprise a cover discharging unit provided in the tub cover and configured to discharge the water collected in an upper area of the tub cover to a lower area of the tub cover. A plurality of such cover discharging units may be provided along a circumferential direction of the tub cover.

The moisture or water flowing along the upper area of the tub cover may be discharged into the lower area of the tub cover via the cover discharging units before reaching the accommodating area.

The laundry treating apparatus may further comprise a water supply unit provided in an upper rear area of the tub cover and configured to supply wash water, wherein the tub cover comprises a shut-off rib configured to shut off the water discharged from the water supply unit from being moved towards the sensor unit along the upper area of the tub cover.

The sensor unit may be provided in the upper area of the tub cover, adjacent to the water supply unit. Accordingly, the moisture or water flowing towards the sensor unit may be blocked by the cover discharging unit in one side of the sensor unit and blocked by the shut-off rib in the other side of the sensor unit.

Embodiments of the present disclosure may also provide a laundry treating apparatus comprising a tub provided to hold wash water; a drum rotatably provided in the tub and comprising a shaft which is perpendicular with the ground; a sub-drum detachably mounted to an inner circumferential surface of the drum and configured to wash laundry, independent from the drum; a tub cover provided in an upper surface of the tub and comprising a laundry introduction opening formed therein; a magnet unit provided in the sub-drum; a hall sensor provided in the tub cover and configured to sense the magnet unit; and a mounting portion provided in the tub cover and configured to mount the hall sensor to the tub cover and prevent water from being drawn into the hall sensor.

When the hall sensor senses the magnet unit, it may be determined that the sub-drum is mounted in the drum.

The magnet unit is strong in the moisture or water. On the other hand, the hall sensor is connected with a signal wire and it is weak in the moisture. Accordingly, it is preferred that the hall sensor is protected from the moisture or water. On the other hand, the hall sensor may be located adjacent to the magnet unit. With that reason, the hall sensor may be mounted in the mounting portion and it is necessary to prevent the moisture or water from being drawn into the hall sensor via the mounting portion.

The mounting portion may comprise an accommodating area recessed from the tub cover and provided to accommodate the sensor unit; and a cover area comprising an accommodating area cover rotatably provided in the tub cover and configured to selectively close the accommodating area and a hinge unit configured to rotatably connect the accommodating area cover to the tub cover.

The laundry treating apparatus may further comprise a fixing unit comprising a cover hook provided in the accommodating area cover; and a hook groove recessed from some area of the accommodating area to have the cover hook insertedly coupled thereto.

The hook groove may facilitate communication the accommodating area with the outside to expose one end of the inserted cover hook. Accordingly, the cover hook may be inserted in the hook groove from the inside towards the outside of the accommodating area.

The accommodating area may be partitioned off into a sensor seating area provided to seat the sensor unit therein; and a damping area in communication with the outside via the hook groove by a blocking protrusion provided in a lower surface of the accommodating area.

The thickness of the hinge unit may be smaller than the thickness of the accommodating area and the accommodating area cover. Accordingly, the hinge unit may be structurally foldable.

The hinge unit may be located in an inner area with respect to a radial direction of the tub cover, and the accommodating area cover is rotated towards an outer area with respect to the radial direction from the hinge unit to cover the accommodating area.

The laundry treating apparatus may further comprise a water supply unit provided in an upper rear area of the tub cover and configured to supply wash water, wherein the tub cover comprises a shut-off rib configured to shut off the water discharged from the water supply unit from being moved towards the sensor unit along the upper area of the tub cover; and a plurality of cover discharging units provided from an upper area of the tub cover along a circumferential direction and configured to discharge the water collected in the upper area of the tub cover to a lower area of the tub cover, and the sensor unit is located between the shut-off rib and the cover discharging unit.

Accordingly, the sensor protection of the mounting portion structure and the moisture blocking of the shut-off rib and the cover discharging unit may be actuated combinedly.

Detailed characteristics of the embodiments may be realized combinedly in other embodiments, unless they are contradictory or exclusive.

Advantageous Effects

The embodiments have following advantageous effects. According to the embodiments of the present disclosure, the laundry treating apparatus may include a sub-drum easily mountable in a main-drum and which may independently separate the washing for the main-drum from the washing for the sub-drum. Especially, the object is to provide a laundry treating apparatus which may substantially separate water supply and water drainage from each other.

Furthermore, the laundry treating apparatus is capable of achieving a sufficient washing effect by using only the sub-drum.

Still further, the laundry treating apparatus may allow a user to additionally load laundry the main-drum as well as the sub-drum.

Still further, the laundry treating apparatus may effectively discharge wash water from the sub-drum, without being drawn into the main-drum.

Still further, the laundry treating apparatus may discharge the wash water held in the sub-drum only in a dry-spinning cycle, without discharging the wash water in a washing cycle. Especially, the laundry treating apparatus may realize the object of the water discharging structure, without an auxiliary drive unit such as a drainage pump connected with the sub-drum.

Still further, the laundry treating apparatus may prevent water leakage to a sensor provided in a tub cover to sense the rotation of the sub-drum during the washing and which discharge the water collected in the tub cover fast, while preventing the water from flowing back up to an outlet hole provided to discharge.

Still further, the laundry treating apparatus which may easily mount the sensor to the tub cover without an additional component provided in the tub cover, which is provided in the conventional laundry treating apparatus.

Still further, the laundry treating apparatus may integrally form a structure configured to mount the sensor to the tub cover.

DESCRIPTION OF SPECIFIC EMBODIMENTS

Referring to the accompanying drawings, exemplary embodiments of the present disclosure according to one embodiment of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Figure 1:
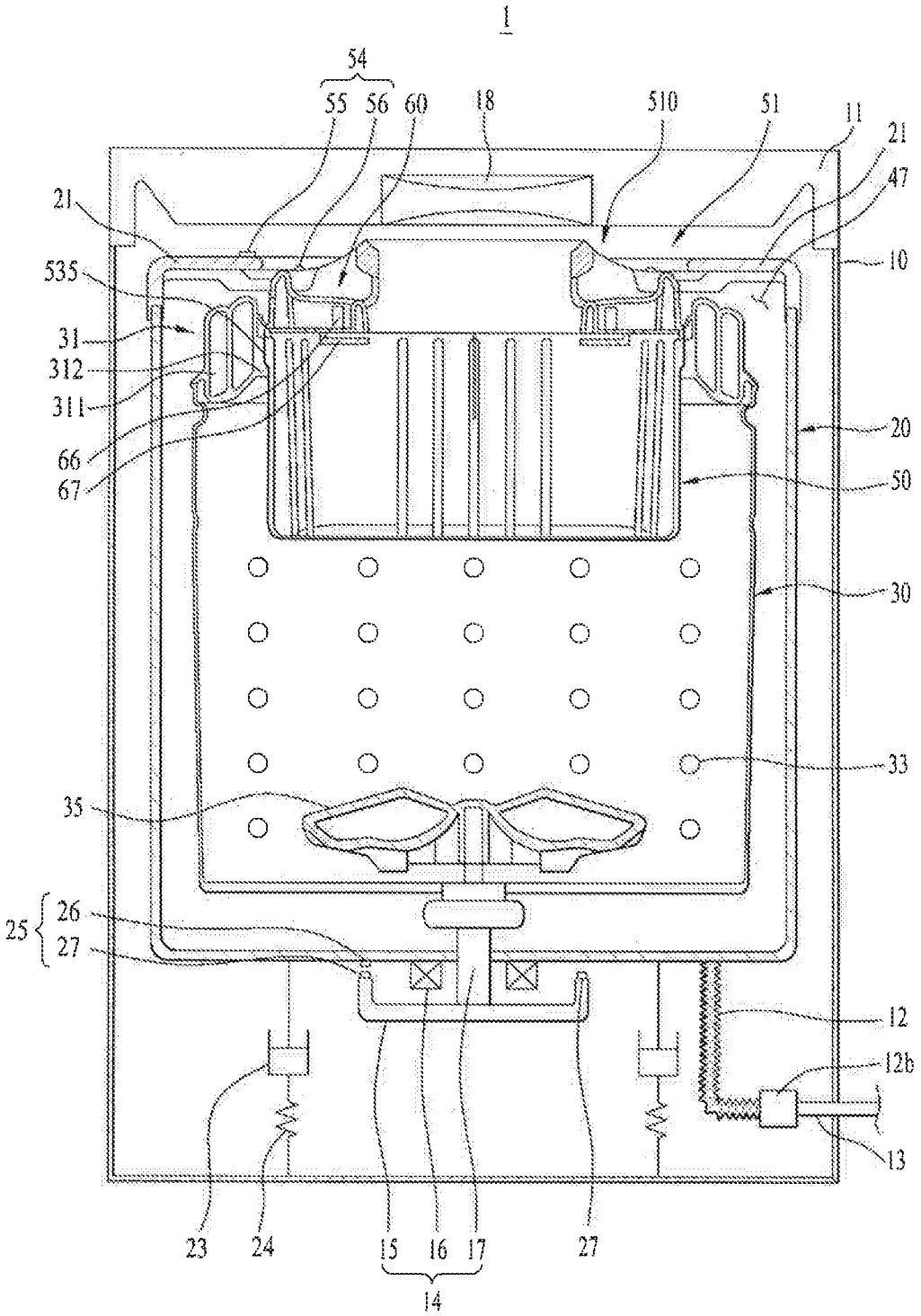
FIG. 1 is a schematic diagram illustrating a structure of a laundry treating apparatus in accordance with one embodiment of the present disclosure.

FIG. 1 is a schematic diagram illustrating a structure of a laundry treating apparatus 1 in accordance with one embodiment of the present disclosure.

Referring to FIG. 1, the laundry treating apparatus 1 in accordance with the embodiment includes a cabinet 10 having an opening formed in an upper portion to load clothes or laundry (hereinafter, the laundry); a door (not shown) coupled to the opening to open and close the opening; a tub 20 mounted in the cabinet 10 and configured to store wash water; and a drum 30 rotatably mounted in the tub 20.

The laundry treating apparatus may further include a drive unit 14 configured to drive the drum 30; and a pulsator 35 configured to rotate in the drum 30 so as to form water currents in the wash water supplied to the drum and the tub.

The drive unit 14 may be provided to selectively rotate the drum 30 and the pulsator 35.

Meanwhile, the laundry treating apparatus in accordance with the embodiment includes a sub-drum 50 detachably mounted in the drum 30 and configured to perform washing, independent from the washing in the drum 30.

In the embodiments of the present disclosure, the wash water for washing the laundry and the wash water for washing the door and the like are referred to as 'the wash water' and the drum 30 is referred to as 'the main-drum'.

FIG. 1 shows a direct-type motor drive structure which directly connects a motor to a shaft 17 to drive the drum 30. However, the laundry treating apparatus 1 in accordance with the illustrated embodiment is not limited thereto.

The cabinet 10 may define the exterior appearance of the laundry treating apparatus 1 and include a cabinet cover 11 having an opening to communicate the inside of the cabinet with the outside so as to load the laundry.

The cabinet cover 11 is provided in an upper end of the cabinet 10 and the door (not shown) is rotatably coupled to a top of the opening to selectively open and close the opening. Accordingly, a user is able to load or unload the laundry into or from the drum 30 and the sub-drum by opening and closing the door.

Meanwhile, a water supply unit 18 is provided in the cabinet cover 11 to supply the water mixed with detergent or clean water with no detergent to the drum 30 and the sub-drum 50. The wash water exhausted from the water supply unit 18 may be supplied to the drum 30 and/or the sub-drum 50.

The wash water exhausted from the water supply unit 18 may be supplied only to the drum 30 or only to the sub-drum 50. It is necessary not only to separate a laundry accommodating space of the drum 30 from a laundry accommodating space of the sub-drum 50 but also to separate the wash water supplied to the drum 30 from the wash water supplied to the sub-drum 50. In other words, it is necessary to limit the supply of the wash water supplied to the sub-drum 50 and to the drum 30 and vice versa, because a contamination level or fabric type of the laundry loaded in the drum could be different from a contamination level or fabric type of the laundry loaded in the sub-drum. Accordingly, it is also necessary to separate the laundry and the wash water supplied to the drum from the laundry and the wash water supplied to the sub-drum.

In the illustrated embodiment, the wash water is selectively supplied to the drum 30 or the sub-drum 50 via the inside of the tub 20 based on the rotation of the sub-drum 50. In other words, the wash water may be directly supplied to the internal space of the drum 30, not passing through the internal space of the sub-drum and the internal space of the sub-drum 50, not passing through the internal space of the drum 30. The wash water supplied to the drum 30 and the wash water supplied to the sub-drum 50 are not mixed during the wash cycle and it is preferred that they are not mixed in the internal space of the drum 30 and the internal space of the sub-drum 50 even during the dry-spin cycle and the water drainage process.

The tub 20 is formed in a cylinder shape with an open top and mounted in the cabinet 10 to accommodate the wash water. The tub 20 includes a tub cover 21 installed at an upper end.

The tub cover 21 may be located higher than an upper end of the drum 30 and an upper end of the sub-drum 50 mounted in the drum 30. A laundry introduction opening 580 is formed in the tub cover 21, corresponding to the opening of the cabinet 10. The laundry may be loaded into the drum or the sub-drum via the laundry introduction opening 580.

A lower surface of the tub 20 is flexibly supported by a spring 24 and a damper 23 which are installed in the cabinet 10. As the lower surface is directly supported by the spring 24 and the damper 23, the tub 20 may be configured so as not to rotate relative to the drum 30. For example, the tub may not be provided with an auxiliary rotational force by the drive unit 14, different from the drum 30. FIG. 1 shows that the spring 24 and the damper 23 are serially connected to the lower surface of the tub 20 and the embodiments of the present disclosure are not limited thereto. If necessary, the spring 24 and the damper 23 may be connected to the lower surface in parallel. Alternatively, the damper 23 may be connected to the lower surface of the tub 20 and the spring 24 may be connected to an upper surface of the tub 20 and vice versa.

A drainage mechanism configured to drain water may be connected to the lower surface of the tub 20. The drainage mechanism includes a drainage pump 12*b* for providing a power to drainage the wash water held in the tub 20; a first drainage pipe 12 having one end connected to the lower surface of the tub and the other end connected with the drainage pump 12*b* so as to guide the wash water toward the drainage pump 12*b*; and a second drainage pipe 13 having one end connected with the drainage pump 12*b* and the other end connected with one side of the cabinet 10 so as to drain the wash water outside the cabinet 10 from the drainage pump 12*b*. The first drainage pipe 12 may be a bellows pipe not to transfer the vibration of the tub 20 to the drainage pump 12*b*.

The drive unit 14 includes a motor configured of a rotor 15 and a stator 16; and a shaft 17 connected with the rotor 15. As a clutch (not shown) is provided in the drive unit 14, the drive force may be transferred to the drum 30 and the pulsator 35. For example, when the shaft 17 is selectively coupled to the drum 30 in a state of being fixed to the pulsator 35, the drive unit 14 may transfer the drive force to the pulsator 35 or both of the pulsator 35 and the drum 30. As another example, the shaft 17 is selectively coupled to the pulsator in a state of being fixed to the drum 30 and the drive unit 14 may then transfer the drive force to the drum 30 or both of the pulsator 35 and the drum 30.

As mentioned above, the shaft 17 may be fixed to one of the pulsator 35 and the drum 30 and selectively coupled to the other one. However, such description may not exclude the structure configured to selectively couple the shaft only to the pulsator 35 or the drum 30.

The laundry treating apparatus 1 in accordance with one embodiment includes the drum 30 rotatably mounted in the tub 20 and configured to hold clothes or laundry; and the sub-drum 50 detachably mounted in the drum 30.

The drum 30 may be formed in a cylinder shape with an open top and an approximately circular cross-section and a lower surface directly connected with the shaft 17 to receive the rotational force from the drive unit 14.

The drum 30 may be formed in the cylinder shape with the open top and a plurality of through-holes may be formed in a lateral wall, in other words, a circumferential surface. The drum 30 may be in communication with the tub 20 via a plurality of through-holes 33. Accordingly, when wash water is supplied to the tub 20 to a preset water level or more, the drum 30 becomes submerged in the wash water and some of the wash water may flow into the drum via the through-holes 33.

The drum 30 includes a drum cover 31 provided in an upper end. The drum cover 31 is formed in a hollow ring shape and arranged in a lower area of the tub. An outlet path 47 is horizontally extended by the upper surface of the drum cover 31 and the lower surface of the tub cover 21. The outlet path 47 may be provided to guide the wash water exhausted outside via a lateral surface of the sub-drum 50 toward the inside of the tub 20 again.

The wash water held in the drum 30 is drawn toward inner and lower walls of the tub via the through-holes 33 of the drum 30 and then drained. The wash water held in the sub-drum 50 is drawn toward the inner wall of the tub via the top of the sub-drum 50. In other words, the wash water flows in a side gap between the drum 30 and the tub 20 via the outlet path 47 and then to the lower wall of the tub to be drained outside. Accordingly, the wash water held in both the drum 30 and the sub-drum 50 is not mixed with each other in the drum 30 and the sub-drum 50, when drained outside. Also, the wash water supplied to both the drum 30 and the sub-drum 50 is not mixed with each other.

The drum cover 31 has an opening so as to load the laundry or mount the sub-drum 50 therein. Also, the drum-cover 31 also has a balancer 311 provided to compensate the unbalance caused by an eccentric load of the laundry in the drum.

The drum cover 31 may include a first uneven portion 312 formed in an inner circumferential surface to facilitate the demounting of the sub-drum 50; and an uneven area 312 projected from the inner circumferential surface to prevent the upward movement of the drum 30 by interfering with a coupling unit 93 of the sub-drum 50 which is provided to be coupled to the first uneven portion 312. The uneven area 312 may include a hooking portion. In this instance, the coupling unit 93 is able to be flexibly movable into or from the sub-drum 50, in communication with a handle unit 510.

Figure 6:
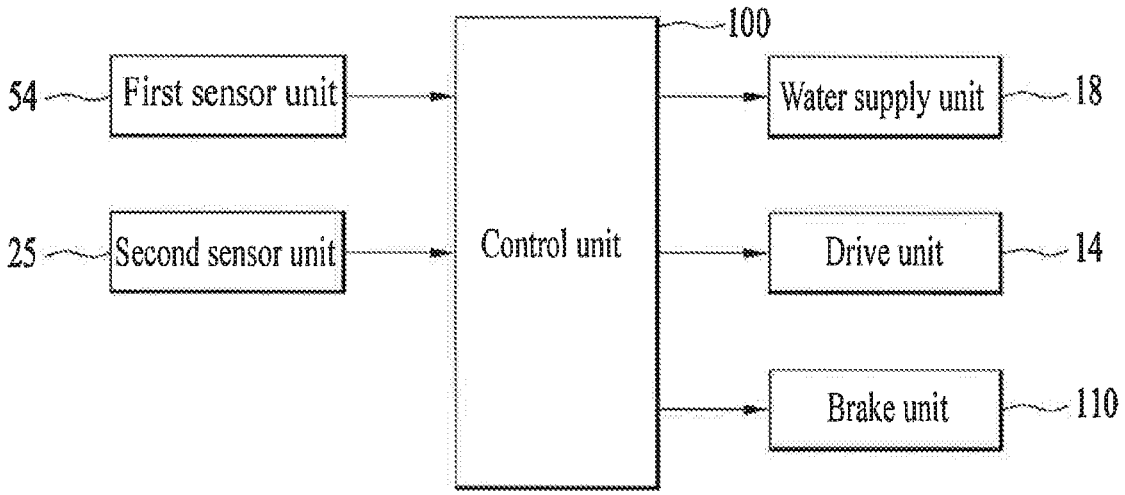
FIG. 6 is a block diagram illustrating the structure of the laundry treating apparatus in accordance with the embodiment.

Meanwhile, the laundry treating apparatus in accordance with the embodiment may include a control unit (100, see FIG. 6 and a brake unit (110, see FIG. 6) so as to control the overall washing process. Also, the laundry treating apparatus may include a sensor unit configured to control an angle of the sub-drum 50 which will be described later. The sensor unit may include a first sensor unit 54 and a second sensor unit 25. The angle control of the sub-drum 50 may be performed for the water supply. As one example, it may be determined based on the angle control of the sub-drum 50 whether to perform the water supply to the inside of the drum 30 via the same water supply unit or to the inside of the sub-drum 50.

The first sensor unit 54 may include a first hall sensor 55 and a first magnet unit 56. The first hall sensor 55 may be provided in an upper surface of the tub cover or an inner circumference of the tub cover 21. In other words, the first hall sensor 55 may be provided in one of the fixed elements. The first magnet unit 56 may be installed on an upper surface of the sub-drum to be sensed by the first hall sensor 55.

When the sub-drum 50 is rotated, the first hall sensor 55 senses the first magnet unit 56 and transmits a signal to the control unit 100. In the illustrated embodiment, one hall sensor and one magnet are provided in the first sensor unit 54 for easy understanding. However, the embodiments of the present disclosure are not limited thereto and the first sensor unit 54 may include a plurality of hall sensors and a plurality of magnets. Or, it may include one hall sensor and a plurality of magnets. The plurality of magnets may be arranged at intervals having a preset angle. When one magnet is provided in one hall sensor, the hall sensor may generate one magnet sensing signal per one rotation of the sub-drum 50. When three magnets are provided in one hall sensor, the hall sensor may generate three magnet sensing signals per one rotation of the sub-drum 50. The first sensor unit 54 may determine whether the sub-drum 50 is mounted in the drum 30. Also, the first sensor unit 54 may determine whether the sub-drum 50 is mounted in the drum 30 normally.

As one example, when the first hall sensor 55 generates three magnet sensing signals per one rotation of the drum 30, the first hall sensor 55 may generate only two magnet sensing signals. In this instance, it may be determined that the sub-drum 50 is mounted in the drum abnormally.

When it is determined that the sub-drum 50 is mounted in the drum 30 normally, the sub-drum 50 and the drum 30 may be integrally rotated as one body. In other words, the rotation angle of the sub-drum 50 may be controlled by controlling the rotation angle of the drum 30.

In this embodiment, the second sensor unit 25 may be provided to control the rotation angle of the drum 30. More specifically, the sensor unit 25 may be provided to sense the rotation angle of the drum 30 and the rotation angle of the drum 30 may be controlled based on the result of the sensing of the second sensor unit.

More specifically, the second sensor unit 25 may include one second hall sensor 26 and a second magnet unit 27 so as to sense the rotation angle of the drum 30. The second hall sensor 26 may be provided on a bottom surface of the tub 20 and magnets of the second magnet unit 27 may be arranged along an outer circumference of a top surface of the rotor 15 to be sensed by the second hall sensor 26. When the drum 30 is rotated, the second hall sensor 26 senses the rotation angle of the drum 30 and then transmits a signal to the control unit 100. To allow the second sensor unit 25 to sense the precise rotation angle of the drum 30, the magnets of the second magnet unit 27 are provided on the rotor 15 at the equidistant intervals. The more magnets provided, the more precise rotation angle of the drum may be sensed. In other words, the rotation angle of the drum 30 is determined based on the rotation angle of the rotor 15 sensed by the second sensor unit 25. Meanwhile, the second sensor unit 25 may include the hall sensor fixedly provided on the stator; and a plurality of magnets provided on the rotor and rotatable together with the rotor.

Meanwhile, the rotation angle of the rotor 15 may be sensed without auxiliary sensors. In other words, the rotation angle of the rotor 15 may be sensed according to a sensorless method to determine the rotation angle of the drum 30. Such a sensorless method may be configured to allow a phase current of a preset frequency to flow to the motor and estimate the location of the rotor provided in the motor based on the output currents detected while the currents of the preset frequency flow to the motor. Such a sensorless method may be well-known knowledge and detailed description thereof will be omitted accordingly.

The control unit 100 is configured to control the overall operation of the laundry treating apparatus (e.g., the wash cycle, the rinse cycle, the dry-spin cycle and the like) and operate the laundry treating apparatus according to the user's setting.

Especially, the control unit 100 may be implemented to receive the signals generated by the first sensor unit 54 and the second sensor unit 25 and control the drive unit 14 configured to rotate the drum 30, the water supply unit 18 configured to supply wash water and the brake unit 110 configured to apply a brake to the rotating drum 30 based on the received signals. The control unit may perform the control of the rotation angle of the sub-drum 50 based on the control of the rotation angle of the drum 30. In other words, the control unit may control the sub-drum 50 to stop at a desired rotation angle.

The brake unit 110 is implemented to stop the drum 30 by applying a brake to the rotating drum 30. In other words, the control unit may control the drum 30 and the sub-drum 50 to stop at a preset rotation angle.

Hereinafter, the sub-drum 50 will be described in detail, referring to FIGS. 2 through 4.

Figure 2:
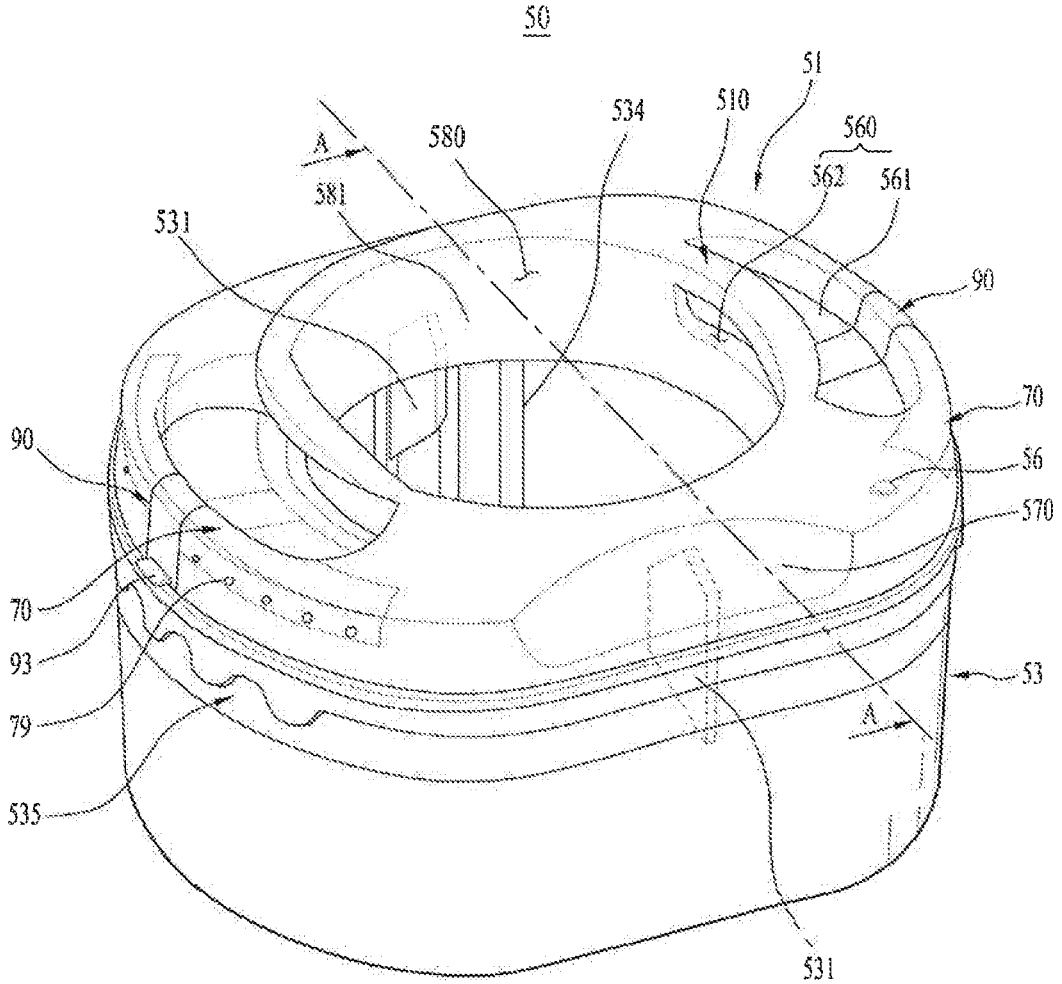
FIG. 2 is a perspective diagram illustrating a sub-drum which is shown in FIG. 1.
Figure 3:
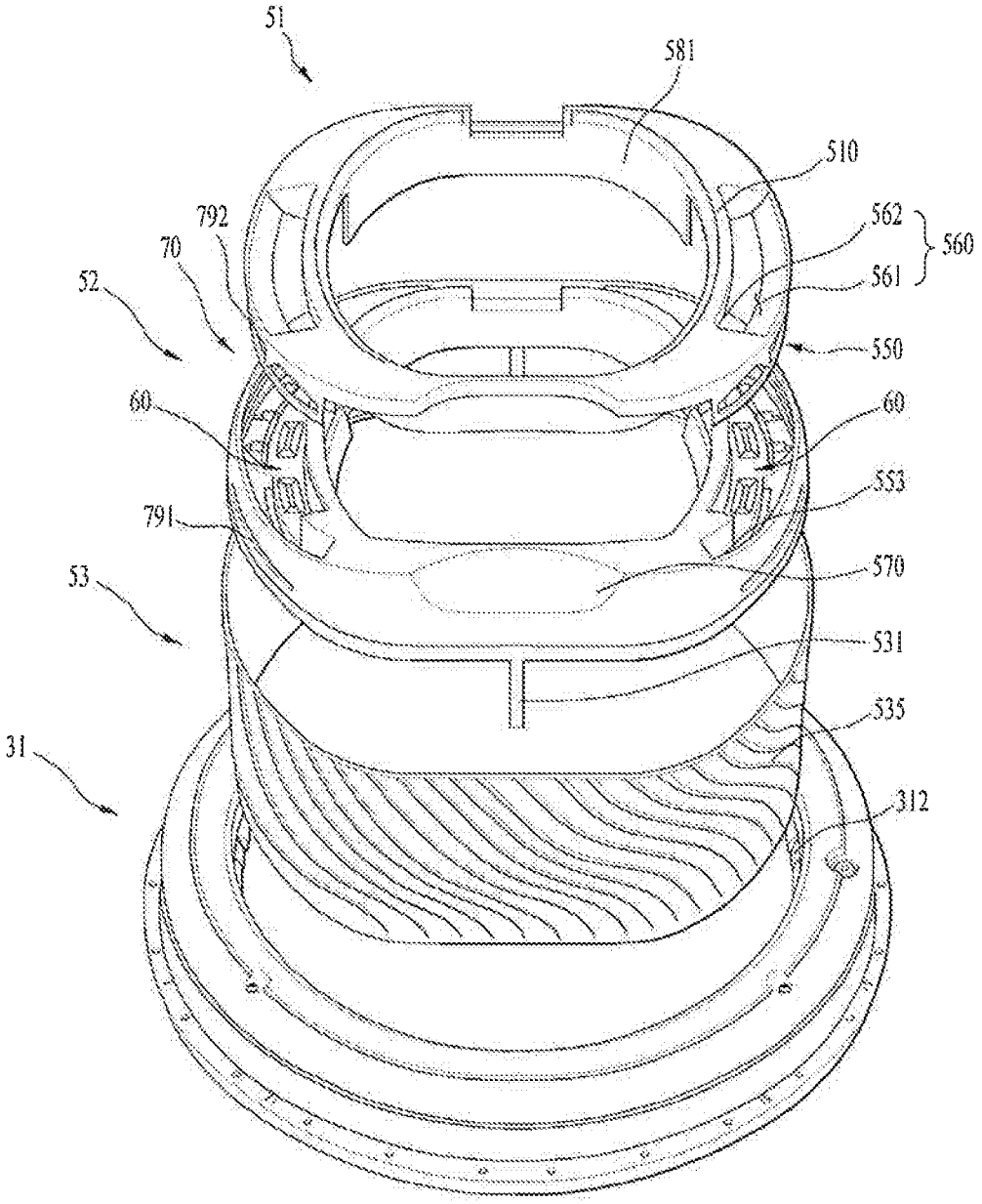
FIG. 3 is an exploded perspective diagram of the sub-drum shown in FIG. 1.

FIG. 2 is a perspective diagram illustrating the sub-drum 50 which is shown in FIG. 1. FIG. 4 is a sectional diagram along a line A-A which is shown in FIG. 2. FIG. 5 is a plane view illustrating the sub-drum 50 mounted in the drum 30. FIG. 3 is an exploded perspective diagram of the sub-drum shown in FIG. 1.

Referring to FIGS. 2 through 5, the sub-drum 50 may be detachably mounted in an upper end area of the drum 30. The sub-drum 50 has a kind of a container shape with an open top. The laundry may be loaded or unloaded through the open top. Also, wash water may be supplied to the internal space of the sub-drum via the open top and a cross section of the sub-drum may be formed in an approximately circular shape.

The sub-drum 50 may be configured to perform washing, independent from the drum 30. After the laundry is sorted according to the color or fabric type and dividedly loaded into the drum 30 and the sub-drum 50, washing is performed for the laundry supplied to the drum and the sub-drum simultaneously. Accordingly, the operation frequency of the laundry treating apparatus 1 may be reduced and the waste of the wash water, detergent and energy may be prevented at the same time. Also, the laundry may be sorted according to a contamination degree or the user's intended use of the laundry. As one example, laundry items such as lingerie or underwear may be dividedly washed from the laundry items which are used in cleaning such that the user's satisfaction level about the separated washing may be remarkably enhanced. In addition, the water supply and drainage may be separately performed and the separated washing effect may be substantially enhanced.

The sub-drum 50 may perform the washing while being rotated by the rotational force transmitted from the drum 30 such that no auxiliary drive device need be provided. That is because the sub-drum may be integrally rotated together with the drum.

The sub-drum 50 includes a sub-drum body 53 formed in a cylinder shape with an open top; a sub-drum cover 51 detachably coupled to an upper end of the sub-drum body 53; a discharge area 70 configured to exhaust the wash water held in the sub-drum 50 outside when the sub-drum 50 is rotated at a high speed; and a coupling unit 93 configured to couple and decouple the sub-drum 50 to and from the drum 30.

The sub-drum body 53 has an oval cross section so as to form a vortex in the wash water and a friction rib 534 may be provided in an inner circumferential surface of the sub-drum body 53 to form a water current in the wash water.

The top loading type laundry treating apparatus 1 in accordance with the embodiment may perform the washing process by using the chemical action of the detergent and the friction between the water currents formed by the rotation of the drum and the laundry. The sub-drum body 53 having the oval-shaped cross section may generate the vortex by using the rotation more efficiently than the drum having the circular-shaped cross section. As the vortex increases the friction between the wash water and the laundry, the sub drum 50 having the oval-shaped cross section may enhance the washing efficiency.

Meanwhile, the sub-drum body 53 may include an inner circumferential surface formed with a first curvature area (C1) having a first curvature and a second curvature area (C2) having a second curvature which is smaller than the first curvature, as shown in FIG. 5.

A pair of first curvature areas (C1) may be formed in the areas of the sub-drum body 53 which face each other, respectively, and the first curvature is identical to the curvature of the inner circumferential surface of the opening formed in the drum cover 31.

A pair of second curvature areas (C2) may be formed in the opposite areas of the sub-drum body 53 which face each other, respectively, with being located between the first curvature areas (C1). The second curvature may be smaller than the first curvature.

In other words, the first curvature areas (C1) and the second curvature areas (C2) may be alternatively provided along a circumference of the cross sectional surface formed in the sub-drum body 53.

The inner circumferential surface of the sub-drum body 53 may be divided into a short distance area (C2) spaced a first distance apart from the rotational center of the sub-drum 50; and a long distance area (C1) spaced a second distance apart from the rotation center of the sub-drum 50, the second distance farther than the first distance. The long distance area (C1) corresponds to the first curvature area (C1) and the short distance area (C2) corresponds to the second curvature area (C2).

Meanwhile, a first water supply path 573 which will be described later may be formed as the short distance area (C2) is spaced a sufficient distance apart from the inner circumferential surface of the drum-cover 31.

It is described that some area of the inner circumferential surface which the second curvature area (C2) indicates is curved but the embodiments of the present disclosure are not limited thereto. The area of the inner circumferential surface may be planar. In this instance, it is more appropriate that the second curvature area (C2) is named the short distance area (C2).

The first curvature area (C1), the second curvature area (C2), the long distance area (C1), the short distance area (C2), a coupling area (C1) and a distant area (C2) indicate specific areas. All of the areas which belong to the above-noted specific areas may be referred to as the terms mentioned above. In the disclosure, some areas of the sub-drum body 53 and the sub-drum cover 51 are referred to as the above-noted terms.

Figure 4:
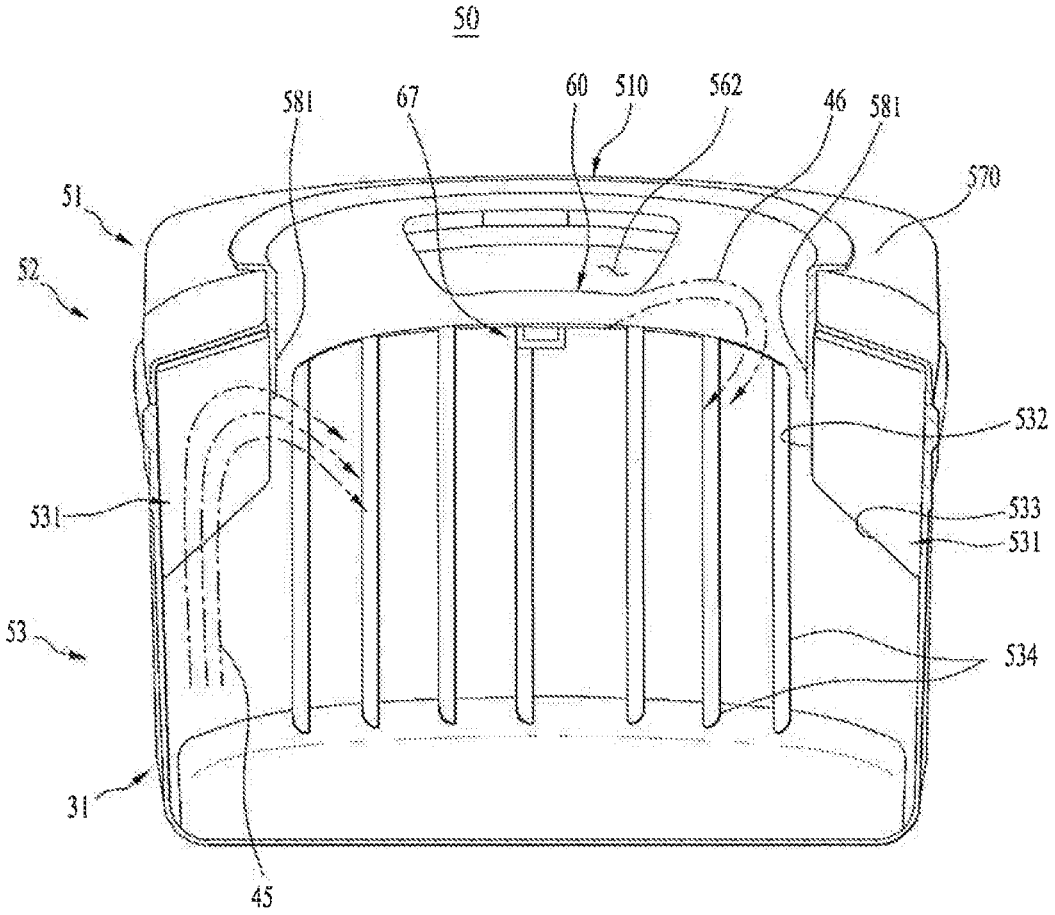
FIG. 4 is a sectional diagram along the line A-A which is shown in FIG. 2.
Figure 5:
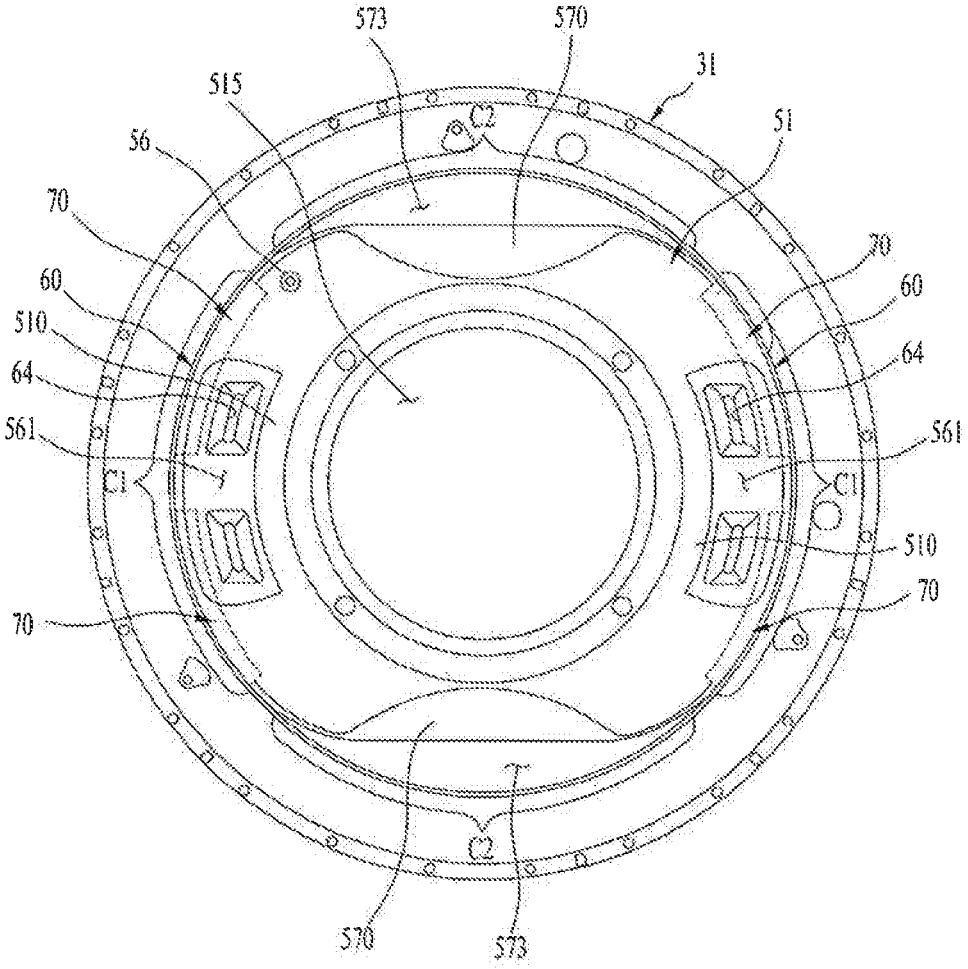
FIG. 5 is a plane view illustrating the sub-drum mounted in a drum.

It is shown in FIGS. 4 and 5 that the cross sectional surface of the sub-drum 50 is oval with respect to the overall height. However, the embodiments are not limited thereto. As one example, one short distance area (C2) may be formed or the short distance area (C2) may be formed only in the sub-drum body 53. In other words, the overall shape of the sub-drum cover 51 is circular and only the sub-drum body 53 provided in the lower area of the sub-drum cover 51 to hold wash water may have the short distance area (C2). Such short distance area may define some space that vertically penetrates the drum from the drum upper portion into the drum interior. Accordingly, it is possible to form a penetrating area (not shown) in the sub-drum cover 51, corresponding to the short distance area.

Accordingly, as mentioned above, it is not necessary to form the overall shape of the sub-drum 50 in the oval shape so as to supply the wash water to the inside of the drum by vertically dropping the wash water via the water supply unit 18, without passing through the sub-drum 50. Any shapes are possible only if the short distance area for allowing the wash water to vertically flow is formed in the sub-drum cover 51. The control of the drum rotation angle may be performed to locate such short distance area to a corresponding area to the water supply unit 18.

Meanwhile, the sub-drum body 53 may include no through-holes 33 formed in the circumferential surface, different from the drum 30 including the through-holes 33 formed in the circumferential surface. Accordingly, the sub-drum body 53 may hold the wash water and the laundry and the wash water may not be exhausted into the drum 30 via the circumferential surface or lower surface. The wash water held in the tub 20 is only drawn into the drum 30 via the through-holes 33, not into the sub-drum 50.

The friction rib 534 may be projected from the inner circumferential surface of the sub-drum body 53 vertically. A plurality of friction ribs 534 may be spaced a preset distance apart from each other and integrally formed with the sub-drum body 53. The friction ribs 534 may be configured to rotate the wash water in the rotational direction of the sub-drum body 53 by frictional force with the wash water during the rotation of the sub-drum body 53. The friction ribs 534 are different from guide ribs 531, which will be described later, in the shape and functions.

The sub-drum cover 51 is coupled to an upper end of the sub-drum body 53, and may have a cross sectional surface which is similar to the cross sectional surface of the sub-drum body 53.

Accordingly, the circumferential surface of the sub-drum cover 51 may be divided into a first curvature area (C1) and a second curvature area (C2). The first curvature area (CL) may be named a first long distance area (C1) and the second curvature area (C2) may be named a second short distance area (C2). Different from the first and second curvature areas (C1) and (C2) of the sub-drum body 53, the first curvature area (C1) of the sub-drum cover 51 is coupled to the inner circumferential surface of the drum cover 31 and may be named a distant area. Also, the second curvature area (C2) of the sub-drum cover 51 is spaced apart from the inner circumferential surface of the drum cover 31 and then may be named a distant area.

The sub-drum cover 51 may include a laundry introduction opening 580 formed in an upper surface to introduce the laundry; and a handle unit 510 which provides a predetermined space to be grabbed by the user.

In addition, the sub-drum cover 51 may include an inner water supply guide 560 configured to guide the wash water exhausted from the water supply unit 18 into the sub-drum 50; and an outer water supply guide 570 configured to guide the wash water exhausted from the water supply unit into the drum 30 along an outer surface of the sub-drum 50.

The inner water supply guide 560 may function to guide the wash water supplied via the water supply unit 18 into the sub-drum smoothly, not into the drum simultaneously.

The outer water supply guide 570 may function to guide the wash water supplied via the water supply unit 18 into the drum smoothly, not into the sub-drum simultaneously.

The sub-drum cover 51 includes a guide rib 531 provided to lift the wash water circulating along the inner circumferential surface of the sub-drum body 53 after the flow direction is changed by collision and fall to the center of the sub-drum body 53.

The handle unit 510 may be formed in an upper surface of the sub-drum cover 51 and include a pair of handle units 510 facing each other.

The handle unit 510 may be arranged adjacent to the first curvature area (C1), in other words, the long distance area (C1) of the sub-drum cover 51. When the wash water is one-sided by the shock applied when the user demounts the sub-drum 50 from the drum 30, rolling might occur in a left-and-right direction while the sub-drum 50 is rotating on a virtual axis passing the pair of the long distance areas (C1). When the handle unit 510 is provided near the second curvature area (C2), in other words, the short distance area (C2), the user has to apply a strong force so as to steady the vertical vibration of the sub-drum 50 such that it may be more advantageous to locate the handle unit 510 near the long distance area (C1).

The inner water supply guide 560 is provided in an upper surface of the sub-drum cover 51, more specifically, the long distance area (C1), in other words, a coupling area (C1). The inner water supply guide 560 may include a concave area 561 and a water supply hole 562.

To form the concave area 561, some area is recessed from the upper surface of the sub-drum cover 51 not to spread the wash water exhausted from the water supply unit 18 around after being collided against the upper surface of the sub-drum cover 51.

The water supply hole 562 is formed in an inner surface of the concave area toward the laundry introduction opening 580 to communicate the concave area 561 with the laundry introduction opening 580. Accordingly, as the wash water is guided to the laundry introduction opening 580 via the water supply hole 562 from the concave area 561, the water supply hole 562 may form a second water supply path 562 to guide the wash water to the sub-drum 50.

The wash water exhausted from the water supply unit 18 is temporarily stored in the concave area 561 such that the wash water may not be spread around the sub-drum cover 51 and then exhausted to the laundry introduction opening 580 via the water supply hole 562, in other words, the second water supply path 562 to be guided into the sub-drum 50.

Meanwhile, the concave area 561 and the water supply hole 562 may be formed in a lower area of the handle units 510 such that the spatial efficiency of the sub-drum cover 51 can be maximized.

The outer water supply guide 570 may be provided in the sub-drum cover 51, preferably, the short distance area (C2), in other words, the distant area (C2). More specifically, the outer water supply guide 570 may be spaced apart from the inner water supply guide 560. The sub-drum 50 may be rotated a preset angle together with the drum 30, to locate the inner water supply guide 560 and the outer water supply guide 570 under one water supply unit 18. Accordingly, even when the outer water supply guide 570 is separated from the inner water supply guide 560, the wash water exhausted from one water supply unit 18 may be supplied to the drum 30 and the sub-drum 50, respectively.

The outer water supply guide 570 is formed by recessing a corner of the distance area (C2) into the sub-drum cover 51 and a bottom surface is inclined outwards and downwards with respect to the sub-drum cover 51. The wash water exhausted from the water supply unit 18 may be guided into the drum 30 along the first water supply path 573 defined as the space formed between the distant area (C2) and the outer circumferential surface of the drum 30.

The guide rib 531 may be formed in a plate shape and provided under the upper surface of the sub-drum cover 51, being extended downwards. The guide rib 531 has one surface contacting with the inner circumferential surface of the sub-drum body 53. More specifically, the plate-shaped guide rib 531 has its top coupled to the sub-drum cover 51 and one side surface in contact with the inner circumferential surface of the sub-drum body 53. Accordingly, the wash water held in the sub-drum body 53 is rotated along the inner circumferential surface of the sub-drum body 53 by the rotational force of the sub-drum 50 and the flow direction of the wash water is changed by the collision with the guide rib 531 to flow upwards and fall down to the center of the sub-drum 50 in an arc.

More specifically, the guide rib 531 may be formed in one surface toward the side surface toward the center of the sub-drum body 53. The guide rib 531 may include a rib vertical area 532 downwardly extended from the upper surface of the sub-drum cover 51; and a rib inclined area 533 formed in a lower surface toward the bottom of the sub-drum body 53, downwardly extended from the rib vertical area and the center of the sub-drum 50 toward the inner circumferential surface.

The rib inclined area 533 is spaced apart from the lower surface of the sub-drum body 53, while forming an acute angle with the inner circumferential surface of the sub-drum 50.

As the rib inclined area 533 is formed in the lower surface of the guide rib 531, the laundry rotated and flowing in the inside of the sub-drum body 53, together with the wash water, may be less interfered with. Accordingly, the flow of the laundry may be performed more efficiently and the friction between the laundry items may be increased enough to enhance the washing efficiency or performance.

Meanwhile, even if the rib inclined area 533 is formed in the guide rib 531, a sufficient amount of wash water can be lifted. For example, when the sub-drum 50 is rotated at a high speed, a water level of the wash water held in the inner circumferential surface of the sub-drum body 53 is higher than a water level of the wash water held in the center of the sub-drum body 53. Accordingly, even if the rib inclined area 533 is formed in the guide rib 531, sufficient wash water can be collided with the guide rib 531 to be lifted.

Meanwhile, when the sub-drum 50 is rotated at a relatively low speed, the guide rib 531 may be arranged in the short distance area (C2) of the sub-drum cover 51 to lift a sufficient amount of wash water. The amount of the wash water passing through a virtual section from the center of the sub-drum body 53 to the short distance area (C2) is equal to the amount of the wash water passing through a virtual section from the center of the sub-drum body 53 to the long distance area (C1). Accordingly, the water level of the wash water when passing through the virtual section to the short distance area (C2) from the center of the sub-drum body 53 is higher than the water level of the wash water when passing through the virtual section to the long distance area (C1) such that the guide rib 531 can lift the sufficient amount of the wash water even when the sub-drum 50 is rotated at the low speed.

The guide rib 531 has one surface configured to collide with the wash water and the other opposite surface, which are upwardly inclined toward the flow direction of the wash water. In other words, when viewing the guide rib 531 from the center of the sub-drum body 53 in a radial direction, the width of the lower cross section may be larger than the width of the upper cross section. Accordingly, the wash water may be lifted along the one surface and the other surface of the guide rib 531 more efficiently.

By experiments, it may be shown that high washing efficiency is generated together with an inclined guide, when the horizontal length and the height of the sub-drum 50 is 399 mm and 309.2 mm and the height (H) and the width (W) of the guide rib 531 are 70 mm and 65 mm. When the experiment is performed in a state the height (H) of the guide rib 531 is set as 50 mm and 90 mm with the other values are the same, more enhanced washing performance is gained for some contaminants but an average of the values is lower than an average when the height (H) of the guide rib 531 is set as 70 mm. meanwhile, such values are just one example gained by the experiments and specific values of the sub-drum 50 and the guide rib 531 are not limited thereto.

The pair of the guide ribs 531 is provided in the short distance area (C2), respectively, as mentioned above, and the embodiments are not limited thereto. More guide ribs 531 are provided in the long distance area (C1) to be two pairs.

The inclined guide 581 may be provided above the guide rib 531 and downwardly inclined to the inside of the sub-drum 50. More specifically, the inclined guide 581 is formed along an inner area, in other words, an inner circumferential surface of the laundry introduction opening 580 provided above the guide rib 531.

Without the inclined guide 581, the wash water lifted by the guide rib 531 flows to an upper area of the inner circumferential surface of the sub-drum body 53 and then a lower area of the upper surface toward the center of the sub-drum body 53. After that, the wash water falls into the sub-drum body 53 freely, while drawing an arc.

When the inclined guide 581 is installed, the wash water will not fall freely. In other words, the wash water horizontally flowing along the lower area of the upper surface of the sub-drum cover 51 may form the flow 45 of which a direction is drastically changed downwards by the lower surface of the inclined guide 581. More specifically, the horizontal component speed is partially changed into the vertical component speed. The wash water of which the flow direction is drastically changed is collided against the laundry loaded in the sub-drum body 53 more strongly than the wash water falling down freely. At this time, the inclination angle (Θ) of the inclined guide 581 may be set as approximately 10 degrees with respect to the direction of gravity. The angle at which the flow direction of the wash water is changed may be set larger. Accordingly, a stronger shock may be applied to the laundry loaded in the sub-drum body to enhance the washing performance.

It is described that the inclination angle (Θ) is approximately 10 degrees and such value is one of examples, not limited thereto.

Meanwhile, when the sub-drum 50 is rotated at a high speed, the wash water held in the sub-drum 50 could collide with each other to splash to the laundry introduction opening 580. At this time, the inclined guide 581 is configured to guide the splashed wash water into the sub-drum 50 along the upper surface so as to form the flow 46 to the sub-drum 50.

The sub-drum 50 has a second uneven area 535 formed in an outer circumferential surface to be seated on an inner circumferential surface of a balancer 311 while engaging with the first uneven portion 312 formed in the balancer 311. Such second uneven area 535 may be formed in the coupling area (C1) of the outer circumferential surface of the sub-drum body 53. It is preferred that the second uneven area 535 is not formed in the outer circumferential surface of the sub-drum cover 51. The wash water held in the sub-drum body 53 and the weight of the laundry might separate the sub-drum cover 51 from the sub-drum body 53.

The first uneven area 312 is projected from the inner circumferential surface of the drum cover 31. In addition, projections are upwardly projected from an upper end of the first uneven area 312. The first uneven area 312 is formed over the circumference of the inner circumferential surface of the drum cover 31.

The second uneven area 535 is projected from the outer circumferential surface of the sub-drum. The outer circumferential surface of the sub-drum is divided into a short distance area C2 and a long distance area C1. The long distance area may be coupled to the inner circumferential surface of the drum cover such that the second uneven area 535 may be formed in the long distance area. Projections are continuously and downwardly projected from a lower end of the second uneven area 535. The projections of the second uneven area 535 are configured to engage with the projections of the first uneven area 312.

Accordingly, the rotational force of the drum 30 may be transferred to the sub-drum 50 and the sub-drum 50 may be also rotated together with the drum 30. Meanwhile, the sub-drum 50 includes a discharging area 70 for discharging the water from the sub-drum 50 while the sub-drum 50 is rotated at a high rotation speed. The discharging area 70 is projected adjacent to a first curvature C1, in other words, the long distance area C1 and performs a function of selectively discharging the wash water held in the sub-drum 50 outside by the size of the centrifugal force generated during the rotation of the sub-drum 50.

As described above, the washing process performed by the sub-drum 50 is independently separated from the washing process performed by the drum 30. For that, water supply to the drum 30 has to be separated from water supply to the sub-drum 50. Moreover, the wash water supplied to the sub-drum 50 has to be held in the sub-drum 50 prevent the water from flowing into the drum 30 and the water has to be discharged from the sub-drum 50 in a drainage process and a dry-spinning process.

In other words, the sub-drum 50 has to hold wash water when rotated at a washing rpm to perform the washing and discharge the water when rotated at a dry-spinning rpm which is higher than the washing rpm.

At this time, the discharging area 70 is configured to discharge the water outside only when the centrifugal force generated by the rotation of the sub-drum 50 at the dry-spinning rpm higher than the washing rpm.

Such discharging area 70 may have a chamber (not shown) which accommodates water; an inlet hole (not shown) provided to draw water; and an outlet hole 79 provided to discharge the water from the chamber.

The discharging area 70 may be spaced a preset distance from a lateral wall of the sub-drum 50 in an inner radial direction, while the inlet hole is provided in a bottom surface of the chamber. Accordingly, the entire area of the inlet hole is smaller than the area of the chamber bottom surface with which the water is collided and a first resistance is generated when the water is drawn via the inlet hole. After that, a second resistance is additionally generated to raise the water against the centrifugal force, after flowing outside with respect to a radial direction.

Moreover, the discharging area 70 has the outlet hole 791 provided above the inlet hole and penetrating the lateral wall of the sub-drum 50. Accordingly, when water is drawn into the chamber via the inlet hole, a third resistance is additionally generated to flow outside the radial direction of the sub-drum 50 and then to raise the water against the gravity.

Accordingly, when the sub-drum 50 is rotated at the washing rpm which is lower than the dry-spinning rpm, the wash water may not be discharged from the sub-drum 50. In other words, the wash water is set to be selectively discharged only when the sub-drum 50 is rotated at preset dry-spinning rpm. Of course, such selective discharging may be facilitated even without the configurations including a drainage valve or a drainage pump provided as control objects.

Meanwhile, the sub-drum 50 may include a body 53 configured to hold water and laundry; and a sub-cover coupled to an upper surface of the body 53 and having a laundry introduction opening 515 for loading the laundry.

In this instance, the second uneven area 535 is provided in an outer circumferential surface of the body 53 so as to prevent the sub-cover from being separated from the body 53 by the weight of the water and laundry loaded in the body 53. In addition, the discharging area 70, the guide rib 531, the handle unit 510, the inner water supply guide 560 and the outer water supply guide 570 may be also provided in the sub-cover.

Meanwhile, the sub-cover may be integrally formed as one body. Alternatively, as shown in FIG. 3, the sub-cover may include a lower cover 52 coupled to the upper end of the body 53; and an upper cover 51 coupled to a top of the lower cover 52.

The chamber (not shown) of the discharging area 70 is defined by the coupling between the lower cover 52 and the upper cover 51. In this instance, the inlet hole is provided in the lower cover 52. The outlet hole 79 may include a first outlet hole 791 provided in an upper end of the lower cover 52; and a second outlet hole 792 provided in an upper end of the upper cover 51. Accordingly, after water is drawn into the chamber via the inlet hole, the water is discharged via the outlet hole 79 configured of the second outlet hole 792 and the first outlet hole 791.

The concave area 561 forming the inner water supply guide 560 may be defined by the coupling between the lower cover 52 and the upper cover 51. An upper surface of the lower cover 52 may form a bottom surface of the concave area 561 and some inserted area of the upper cover 51 may form an inclined surface of the concave area 561. The water supply hole 562 forming the inner water supply guide 560 may be defined by the space distance from the handle unit 510 and the upper surface of the lower cover 52.

Meanwhile, a control method of the laundry treating apparatus 1 in accordance with one embodiment may determine whether the sub-drum 50 is mounted in the drum 30 before starting the washing or performing the water supply for the washing. Also, the control method may determine whether the sub-drum is mounted normally and it may be performed by using the first sensor unit 54.

In this instance, the control unit 100 performs preset determination processes based on the sensing signal transmitted from the first sensor unit 54 and the second sensor unit 25 or the sensing signal transmitted from the first sensor unit 54 and the output currents detected while predetermined frequency currents are flowing to the motor and control the water supply unit 18, the drive unit 14 and the brake unit 110 based on the result of the determination processes. The sensing signal transmitted from the second sensor unit 25 and the output currents detected while the preset frequency currents are flowing to the motor are used when the control unit 100 measures the rotation angle of the drum 30. Hereinafter, for easy and convenient description, the second sensor unit 25 is exemplified as the element configured to sense the rotation angle of the drum. Detailed description about the relation between the elements for the water supply will be omitted.

Meanwhile, the embodiment for the location control of the drum 30 and the sub-drum 50 to supply wash water is described. However, the location control of the drum 30 and the sub-drum 50 for the location control of the handle units 510 may be performed.

The user is able to separate the sub-drum 50 from the drum 30 while holding the handle units 510. Accordingly, it is preferred that the handle units 510 are configured to allow the user to easily grab the handle units 510 from the surface of the laundry treating apparatus. The location control of the drum 30 may be performed to locate the handle units 510 at a desired position.

More specifically, the location control of the sub-drum 50 may be performed at a place where the sub-drum 50 is decoupled. As one example, the location control may be performed to pause or end the washing course.

When the sub-drum 50 is mounted in the drum 30 only at a specific location, the location control of the drum may be performed for an easy coupling process. As one example, the location control may be performed to pause the washing without the sub-drum 50 or start and end the washing without the sub-drum 50.

In other words, the rotation location control of the drum 30 and/or sub-drum 50 (the stopping of the drum 30 and/or sub-drum 50 at a preset location) may be performed for the water supply and for easy and convenient mounting and/or demounting of the sub-drum.

Meanwhile, the laundry treating apparatus may be configured to perform one or more washing courses and may include an auxiliary control panel configured to allow the user to select the washing courses. The control panel may include an input unit configured to receive various washing course inputs and a display unit configured to display the input washing courses.

On such a control panel, there may be provided the washing courses for the laundry loaded in the drum 30 and no washing courses for the laundry loaded in the sub-drum 50. In this instance, once the sub-drum 50 is mounted, the laundry treating apparatus 1 may determine and implement a corresponding washing course to the sub-drum 50 out of the preset washing courses.

Accordingly, when trying to use the sub-drum 50 after mounting the sub-drum 50 in the conventional laundry treating apparatus 1 having no sub-drum 50, the user is able to use the control panel of the conventional laundry treating apparatus without change or fixing.

Figure 7:
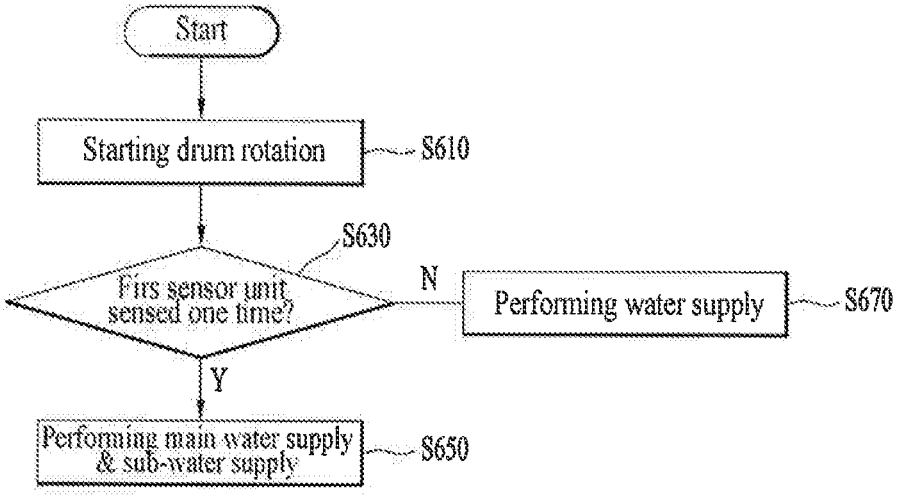
FIG. 7 is a flow chart illustrating a step for determining whether the sub-drum is mounted in the drum.

Referring to FIG. 7, the control method in accordance with one embodiment will be described in detail.

It has to be determined whether the washing course is performed only in the drum 30 or the sub-drum 50. For that, the drum is rotated (S610) and the drum is rotated to determine whether the sub-drum 50 is mounted or whether the sub-drum 50 is mounted properly (e.g., normally or abnormally). It can be said that such determination is performed to determine whether to supply wash water only to the drum 30 or both of the drum 30 and the sub-drum 50.

More specifically, the control unit 100 is implemented to control the drive unit 14 to rotate the drum 30. When the drum 30 is rotated, the second sensor unit 25 senses the rotation angle of the drum 30 and transmits a signal to the control unit 100.

Meanwhile, when a normal signal is not received from the first sensor unit, it may be determined that the sub-drum is not mounted or that the sub-drum is mounted abnormally. As one example, when receiving no signal from the first sensor unit 54 while the second sensor unit 25 senses that the rotation angle of the drum 30 is 360 degrees, the control unit 100 may determine that the sub-drum 50 is not mounted in the drum 30 (S630-N).

When determining that the sub-drum 50 is not mounted in the drum 30, the control unit 100 is implemented to control the water supply unit 18 to supply wash water to the drum 30 (S670). In this instance, the location control of the drum for the water supply may not be performed. In other words, the control unit 100 may not control the drive unit 14 and the brake unit 110 to locate the outer water supply guide 570 or the inner water supply guide 560 under the water supply unit.

When it is determined that the sub-drum 50 is mounted abnormally, an alarm may be provided.

Meanwhile, when a normal signal is received from the first sensor unit, it may be determined that the sub-drum is mounted normally. As one example, when receiving the signal from the first sensor unit 54 while the second sensor unit 25 senses that the rotation angle of the drum 30 is 360 degrees, the control unit 100 may determine that the sub-drum 50 is mounted in the drum 30 (S630-Y).

Once determining that the sub-drum 50 is mounted in the drum 30 normally, the control unit 100 is implemented to perform the location control of the sub-drum 50 so as to supply wash water.

As one example, the control unit performs a main water supply to the drum 30 by locating the outer water supply guide 570 under the water supply unit 18. The control unit 100 may perform a sub-water supply configured to rotate the sub-drum 50 a preset angle and then locate the main water supply and the inner water supply guide 560 under the water supply unit 18 (S650). Of course, the main-water supply may be performed after the sub-water supply.

Once the water supply starts, wash water is exhausted via the water supply unit 18. The exhausted wash water is supplied to the sub-drum 50 via the water supply guide 560 and to the drum 30, in other words, the tub 20 via the outer water supply guide 570. In other words, the water supply is performed after the angle control is performed configured to locate the inner water supply guide 560 and the outer water supply guide 570 under the water supply unit 18 by rotating the sub-drum 50.

For example, the control unit 100 may control the drive unit 14 to rotate the sub-drum 50 at a low rpm for the water supply. In this instance, the rpm is set as '3'. When the first sensor unit 54 transmits a sensing signal to the control unit 100, the control unit 100 may rotate the sub-drum 50 a preset angle from the moment when the first sensor unit 54 sends the sensing signal and locate the outer water supply guide 570 under the water supply unit 18. Such a rotation angle is preset according to the arrangement relation among the first sensor unit 54, the outer water supply guide 570 and the water supply unit 18.

The rotation angle of the sub-drum 50 is measured by the second sensor unit 25 and transmitted to the control unit 100, while the sub-drum 50 is rotated at a very low rpm. The control unit 100 controls the brake unit 110 to stop the sub-drum once determining that the measured rotation angle reaches a preset rotation angle.

As the rpm of the sub-drum 50 is very low, the distance of the sliding of sub-drum 50 from the point when the brake unit 110 starts is so small as to be ignored. When the sub-drum 50 is stopped by the brake unit 110, the outer water supply guide 570 is almost located under the water supply unit 18. Accordingly, the wash water exhausted from the water supply unit 18 may be supplied to the drum 50 via the outer water supply guide 570, without correcting the location of the sub-drum 50.

Meanwhile, as the rpm of the sub-drum 50 is very low, the control unit 100 may cut off the currents flowing to the drive unit from the point or in a preset time period when the first sensor unit 54 senses the location of the sub-drum 50. At this time, the sub-drum 50 may be moving by inertia. However, the angle of the rotation caused by the inertia at low rpm may be so small as to be ignored or expected from the current cut-off point. The stopping location of the sub-drum may be expected at the current cut-off point based on the rpm and the location of the sub-drum at the sensing point of the first sensor unit. The location control of the sub-drum 50 may become simpler on the assumption that there is no large error of the expected location.

The braking caused by the rotation of the sub-drum 50 to supply wash water via the inner water supply guide 560 is equal to the braking caused by the rotation of the sub-drum 50 to supply wash water via the outer water supply guide 570 mentioned above, such that detailed description thereof can be omitted.

Meanwhile, as another example for the precise location control of the sub-drum 50, the control unit 100 may control the drive unit 14 to slidingly move the sub-drum 50 from the point when the brake is applied to the sub-drum by raising the rpm of the sub-drum 50. In this instance, the rpm may be set as '15~25' and the embodiments are not limited thereto.

In this embodiment, the rotation angle to locate the outer water supply guide 570 under the water supply unit 18 when the first sensor unit 54 transmits a sensing signal may be also preset according to the arrangement relation among the first sensor unit 54, the outer water supply guide 570 and the water supply unit 18. However, in the preset rotation angle of this embodiment may be set to be the same value with the preset rotation angle in the above-noted embodiment. Considering the sliding distance of the sub-drum, the preset rotation angle of this embodiment may be smaller than that of the above-noted embodiment.

Similar to the above-noted embodiment, the rotation angle of the sub-drum 50 is measured during the rotation of the sub-drum and the measured values may be transmitted to the control unit 100. Once determining that the measured rotation angle reaches a preset rotation angle, the control unit 100 controls the brake unit 110 to stop the sub-drum 50.

The sub-drum 50 has variable sliding angles at which the sub-drum 50 slides from the brake start point by the wash water held therein and the weight of the laundry. Especially, when the rpm is relatively high, such a sliding angle may vary. When the second sensor unit 25 measures the sliding angle of the sub-drum 50 and transmits the measured angle to the control unit 100, the control unit 100 corrects the preset rotation angle. For example, the control unit corrects the preset rotation angle to be smaller when the sliding angle of the sub-drum 50 is large enough for the outer water supply guide 570 to pass by the lower area of the water supply unit 18. In vice versa, the control unit 100 corrects the preset rotation angle value to be larger. At this time, the rpm is 15~25 rpm which are higher than 3 rpm and lower than 40~49 rpm in the conventional washing such that little load may be applied to the drive unit 14. Accordingly, the overload of the drive unit may be prevented and the precise location control of the sub-drum may be facilitated. In other words, after the correcting process is performed to prevent a deviation or an error, the location control of the sub-drum is performed and the precise location control of the sub-drum may be then performed.

Meanwhile, after water is supplied to the drum 30 and the sub-drum 50, the drive unit 14 is implemented to rotate the drum 30 and the sub-drum 50 and perform the washing process.

In case of washing the laundry loaded in the drum 30, washing may be performed through various drum drive motions. According to one embodiment of the present invention, a basket motion and a pulsator motion may be implemented to wash the laundry loaded in the drum 30. The basket motion is one motion implemented to rotate only the drum and the pulsator motion is one motion implemented to rotate only the pulsator so as to form water currents in the drum. Accordingly, the washing may be substantially performed in the pulsator motion. Of course, the washing may be performed with combinations of various motions including such motions.

Control factors including a combination pattern of motions, a duration of a motion and RPM may be set different according to the selected course. Such control factors may be changed based on information about not only the course but also the options selected by the user. As one example, control factors in the substantially performed course may be changed according to option information such as a contamination level, a water temperature, a dry-spinning RPM, a rinsing frequency and a wash water level.

Accordingly, control factors for washing may be selectable by the user and the selection may be facilitated through various user interfaces that are provided in the control panel. The user interfaces may be configured to perform the washing for the drum 30.

However, when the sub-drum 50 is mounted in the drum 30 to perform washing, it is preferred that diverse washing courses are provided to perform washing for the sub-drum 50. As one example, a special course for lingerie or delicate clothing needs to be performed in the sub-drum 50 or another special course for cleaning tools with severe contamination needs to be performed in the sub-drum 50.

In the basket motion, the drum is rotated and thus the sub-drum 50 is also integrally rotated with the drum. Accordingly, it is possible to realize a plurality of courses for the sub-drum 50 by changing the duration or RPM of the basket motion.

In other words, it is possible to perform a specific course for the sub-drum simultaneously or combinedly together with a specific course for the drum. However, in this instance, it is not easy to further provide an auxiliary user interface in the control panel to select a course for the sub-drum or a corresponding option to the selected course.

Figure 8:
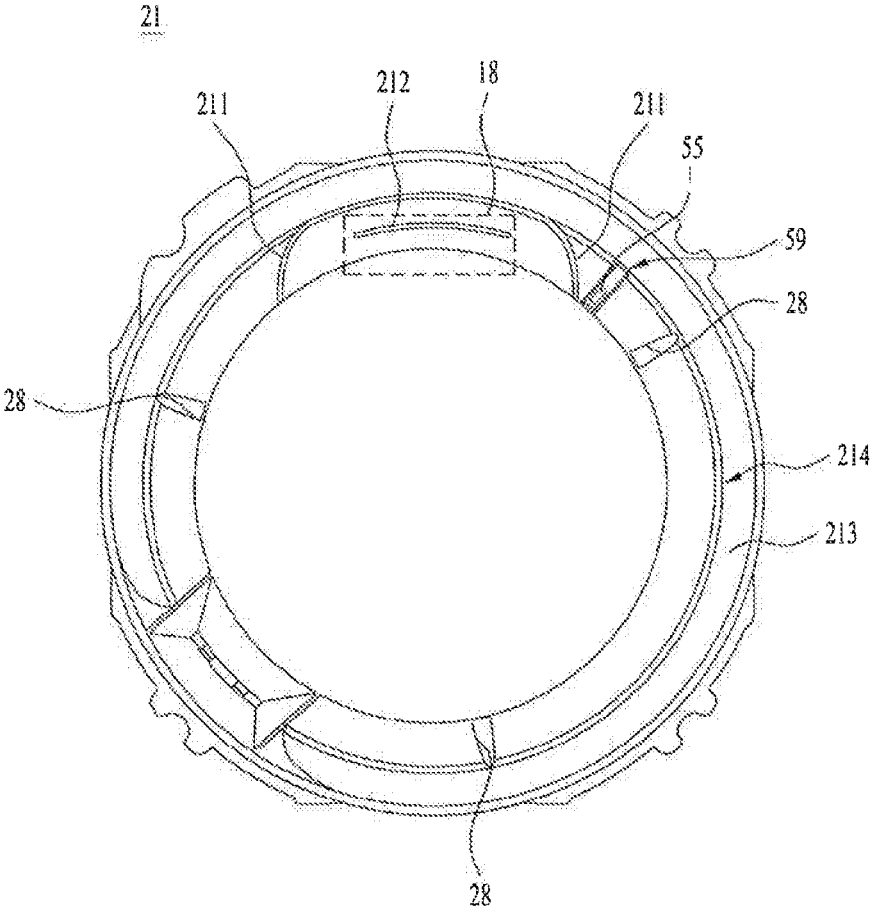
FIG. 8 is a plane view illustrating a sensor unit, a mounting portion and a cover discharging unit which are provided in a tub cover shown in FIG. 1.
Figure 9:
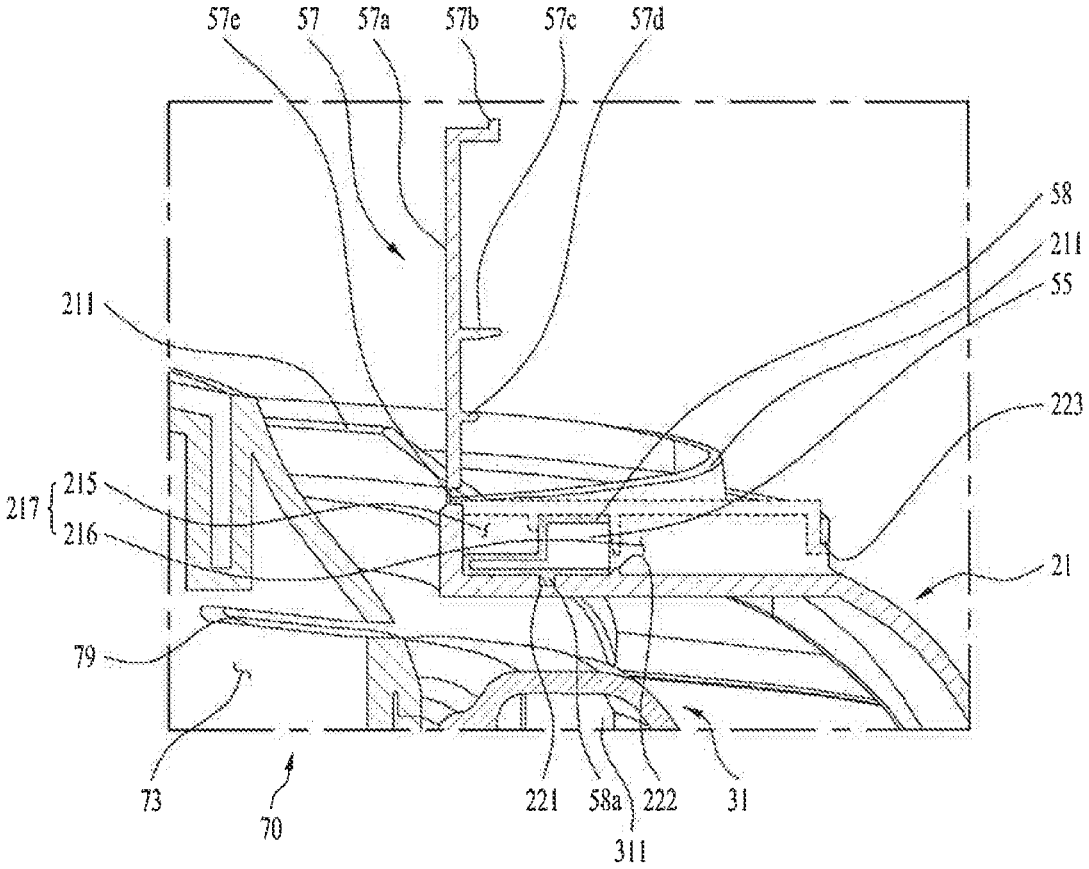
FIG. 9 is a sectional diagram illustrating the mounting portion having the sensor unit shown in FIG. 8 mounted therein.

Hereinafter, referring to FIGS. 8 and 9, the above-noted first sensor unit 54, especially, the structure configured to mount the first sensor unit 54 will be described in detail. FIG. 8 is a plane view illustrating the mounting portion 59 and the cover discharging unit 28 which are provided in the tub cover 21 shown in FIG. 1. FIG. 9 is a sectional diagram illustrating the mounting portion 59 having the first hall sensor 55 shown in FIG. 8 mounted therein.

The tub cover 21 is substantially located higher than the sub-drum 50 when the sub-drum 50 is mounted in the drum 30. The sub-drum 50 is located in an inner portion with respect to a radial direction of the drum 30, in a state of being more projected upwardly than the upper surface of the drum 30.

The tub cover 21 has a profile expanded from an outer area to an inner area with respect to the radial direction of the tub 20. Accordingly, the inner area with respect to the radial direction of the tub cover 21 may be located distant from a close position to the sub-drum 50.

The tub cover 21 is a component coupled to the tub 20 and it is preferred that the tub cover 21 is fabricated to have a unit-body integrally formed with the tub. For example, the tub cover 21 may be integrally formed by plastic injection molding. With that reason, it is preferred that the first sensor unit 54 is mounted in the tub cover 21.

More specifically, the first sensor unit 54 may include a first hall sensor 55 provided in an upper surface of the tub cover 21 or an inner circumferential surface of the tub cover 21. When the sub-drum 50 is rotated or the water supply from the water supply unit 18 is performed, wash water may travel to the tub cover 21 and collect in the tub cover 21. While the first sensor unit 54 can be mounted in the tub cover 21, it is necessary to protect the first sensor unit 54 from moisture such as wash water.

To protect the first hall sensor 55 from the wash water, a mounting portion 59 may be provided in the tub cover 21 and the hall sensor 55 may be mounted in the mounting portion 59. In some embodiments, the mounting portion 59 may be provided in the tub cover 21 to mount and protect the first hall sensor 55. More specifically, the mounting portion 59 may be provided to cover the first hall sensor 55.

It is described that the above-noted first sensor unit 54 is configured as the first magnet unit 56 and the first hall sensor 55 for sensing the first magnet unit 56. That is one of the examples, and the first sensor unit 54 may be configured as an infrared sensor and a reflection unit for sensing the infrared ray emitted from the infrared sensor. In other words, the first sensor unit 54 may be provided with a sensing object and a sensor. The sensing object is mounted in the sub-drum 50 and the sensor is mounted in the tub cover 21. Once the sensor senses the sensing object, it is determined that the sub-drum is mounted.

Hereinafter, a sensing object unit will be discussed. The first magnet unit 56 may be an example of the sensing object unit. The first sensor unit 54 includes a sensing object unit (e.g., first magnet unit 56) provided in the sub-drum 50 and configured to emit a signal; and a sensor unit (e.g., first hall sensor 55) provided in the tub cover 21 and configured to sense the signal emitted from the sensing object unit 56. In this instance, the sensing object unit may be a member for emitting a signal such as the first magnet unit 56 or the infrared sensor. The sensor unit may be a sensor for receiving the emitted signal such as the first hall sensor 55 or the reflection unit. Of course, the sensing object unit may be a magnet configured to generate a magnetic force and the sensor unit may be a hall sensor configured to sense the magnetic force.

The mounting portion 59 may be provided in the tub cover 21 and the sensor unit (e.g., first hall sensor 55) may be mounted in the mounting portion 59. The mounting portion 59 may function to prevent the water drawn from the outside from contacting with the sensor unit (e.g., first hall sensor 55).

More specifically, the mounting portion 59 may include an accommodating area 217 provided in the tub cover 21 and provided to accommodate the sensor unit (e.g., first hall sensor 55); and a cover unit 57 formed to cover the accommodating area 217.

Some area of the upper surface of the tub cover 21 is recessed to form the accommodating area 217. In this instance, considering the volume occupied by the accommodating area 217 recessed downwardly, an upwardly projected area 214 may be provided in the upper surface of the tub cover 21. The accommodating area 217 may be surrounded by the upwardly projected area 214.

The accommodating area 217 may be partitioned off into a sensor seating area 215 for seating the sensor unit 55 thereon; and a damping area 216 accommodating water temporarily, which will be described in detail later.

The cover unit 57 may include an accommodating area cover **57*a* rotatably coupled to the tub cover 21 and configured to selectively open and close the accommodating area 217; and a hinge unit 57*e* configured to rotatably couple the accommodating area cover 57*a* to the tub cover 21**.

The accommodating area cover **57*a* is provided for an open/closing function and to seal the accommodating area 217 from the outside when the accommodating area 217** is closed.

A pair of support projections may be projected from a lower surface of the accommodating area cover **57*a* to fix the sensor unit 55** seated on the seating area.

The pair of support projections may prevent the sensor unit (e.g., first hall sensor 55) from being moved by the centrifugal force generated by the rotation of the sub-drum 50 or the shock caused by an allowance between the components. The pair of support projections may include an inner support projection 57*d* and an outer support projection 57*c*.

The inner support projection 57*d* may be provided adjacent to the laundry introduction opening and the outer support projection 57*c* may be more distant from the laundry introduction opening than the inner support projection 57*d*. In other words, the outer support projection 57*c* may be spaced apart along a direction in which the centrifugal force generated by the rotation of the sub-drum 50 is actuated.

Accordingly, the outer support projection 57*c* may fix the sensor unit (e.g., first hall sensor 55) in the sub-drum 50 so as not to be moved by the centrifugal force during the rotation. The inner support projection 57*d* may prevent the sensor unit (e.g., first hall sensor 55) from being moved towards the center of the sub-drum 50 by the shock generated during the rotation of the sub-drum 50 or a repulsive force with respect to the outer support projection 57*c*.

In this instance, the centrifugal force generated by the sub-drum 50 rotated at a high rotation speed to perform a dry-spinning cycle may be relatively stronger than the other force actuated to the sub-drum 50. The outer support projection 57*c* may be provided longer and stronger than the inner support projection 57*d*, because the tub cover is also rotatable by the vibration of the drum or the sub-drum 50.

The hinge unit 57*e* is provided in the tub cover 21 and rotatably supports the accommodating area cover 57*a*. The hinge unit 57*e* may be fabricated in various shapes. In the exemplary embodiment shown in FIG. 9, the hinge unit 57*e* is made of a flexible material and extended to connect one side of the tub cover 21 with one end of the accommodating area cover 57*a* as one example.

Meanwhile, the mounting portion 59 may be integrally formed with the tub cover 21, not as an auxiliary component assembled with the tub cover 21. Accordingly, when the tub cover 21 is fabricated, the mounting portion 59 may be fabricated at the same time such that the manufacturing cost can be saved while durability can be increased.

In this instance, the mounting portion 59 may be made of the same material and integrally formed with the hinge unit 57*e* and the accommodating area cover 57*a*.

More specifically, the hinge unit 57*e* may be formed thinner than the accommodating area cover 57*a* and the accommodating area 217. In other words, the hinge unit 57*e* may be integrally formed with the above-noted components, with a relatively smaller thickness, so as to be foldable.

In addition, the hinge unit 57*e* may be formed in an inner area of the mounting portion 59 with respect to the radial direction of the tub cover 21. Accordingly, the accommodating area cover 57*a* covers the accommodating area when it is fold towards an outer area with respect to the radial direction via the hinge unit 57*e*. The hinge unit 57*e* may be integrally injection-molded with the tub cover.

Meanwhile, when the cover unit 57 closes the accommodating area 217, a fixing unit may be provided to prevent the cover unit 57 from opening the accommodating area 217 because of the external shock.

Such a fixing unit may include a cover hook 57*b* provided in the accommodating area cover 57*a*; and a hook groove 223 provided in the accommodating area 217 and coupled to the cover hook 57*b*. The cover hook and the hook groove may be formed in the opposite area of the hinge unit 57*e*.

The cover hook 57*b* is provided in the other end of the accommodating area cover 57*a*. The other end is located at the end of the accommodating area cover 57*a* opposite to the hinge unit 57*e*. The cover hook 57*b* may be projected from the lower surface of the accommodating area cover 57*a* and bent to an outer area of the accommodating area cover 57*a*.

Some area of the inner surface of the accommodating area 217 is recessed to form the hook groove 223. When the accommodating area cover 57*a* closes the accommodating area 217, the cover hook 57*b* is inserted in the hook groove 223 and then the accommodating area cover 57*a* is locked to the accommodating area 217.

Meanwhile, the hook groove 223 is formed to facilitate communication between an inside and an outside of the accommodating area. Accordingly, the hook groove 223 may expose the inserted cover hook 57*b* to the outside. When an external force is applied to the cover hook 57*b* under such structure, the cover hook 57*b* is released from the hook groove 223. Accordingly, the accommodating area cover 57*a* is unlocked from the accommodating area 217. The locking and unlocking structure is relatively simple with good durability and low manufacturing cost.

When the hook groove 223 is formed to facilitate communication between the inside and the outside of the accommodating area 217, it is more likely to draw in water from the hook groove 223. When the cover hook 57*b* is fabricated to be forcibly inserted in the hook groove 223 to prevent the water from being drawn in, locking and unlocking might not be performed smoothly.

To solve such a problem, the accommodating area 217 may be partitioned off into two spaces. The sensor unit (e.g., first hall sensor 55) may be seated in one space and water that may be drawn in may stay in the other space temporarily.

More specifically, the accommodating area 217 may be partitioned off into a sensor seating area 215 for seating the sensor unit 55 thereon; and a damping area for communicating with the outside via the hook groove 223. A blocking protrusion 222 may be upwardly projected from the lower surface of the accommodating area 217 between the sensor seating area 215 and the damping area 216 to prevent the flow of water.

Accordingly, water drawn in the hook groove 223 is blocked by the blocking protrusion 222 so as not to be drawn into the sensor seating area 215 having the sensor unit (e.g., first hall sensor 55) seated therein and the water may be naturally evaporated and eliminated as time passes.

A sensor cover 58 may be provided to cover the sensor unit (e.g., first hall sensor 55) so as to stably couple the sensor unit to the sensor seating area 215. The sensor cover 58 has a fixing projection 58*a*. The fixing projection 58*a* is inserted in a fixing projection groove 221 recessed from a lower surface of the sensor seating area 215 to accommodate the fixing projection 58*a*.

Accordingly, when the sensor unit covered with the sensor cover 58 is seated in the sensor seating area 215, the fixing projection is inserted in the fixing projection groove 221 and then the sensor unit (e.g., first hall sensor 55) is stably fixed to the sensor seating area 215.

Figure 10:
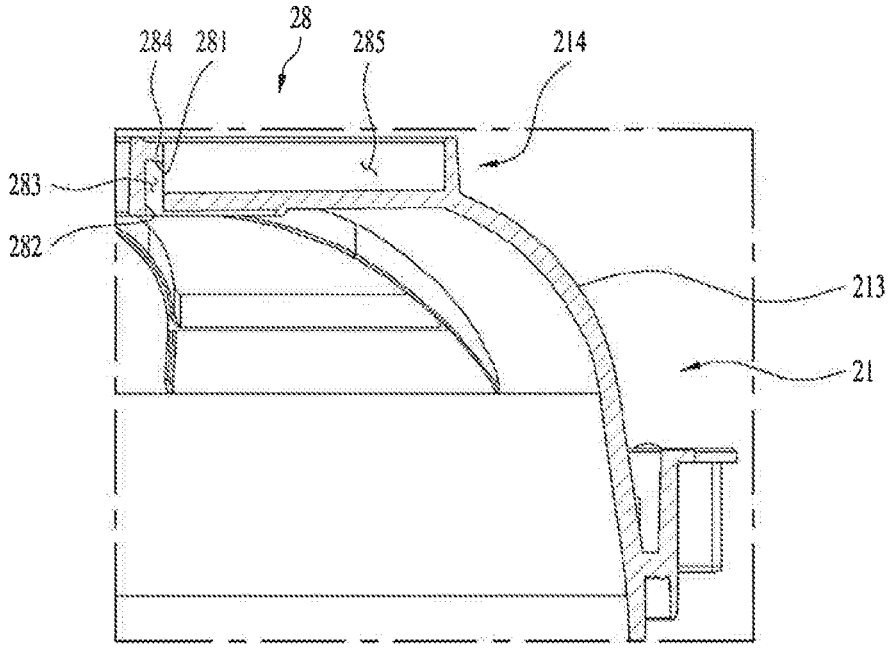
FIG. 10 is a sectional diagram illustrating the cover discharging unit shown in FIG. 8.

Meanwhile, as shown in FIG. 10, the tub cover 21 includes a cover discharging unit 28 configured to discharge the water collected in an upper area of the tub cover 21 to a lower area of the tub cover 21. When water is collected in the upper area of the tub cover 21, the water might be moved to the sensor unit (e.g., first hall sensor 55) by the rotation of the sub-drum 50 and may cause an error of the sensor unit.

Such a cover discharging unit 28 may be provided in an upper surface of the tub cover 21 or an upwardly projected area 214 upwardly projected from the upper surface of the tub cover 21.

The cover discharging unit 28 may include a cover groove 285 recessed from some area of the upper surface of the tub cover 21 and configured to accommodate water; a connection path 283 provided to guide the water downwardly; an upper communication hole 281 provided in the cover groove 285 and configured to communicate with the connection path 283; and a lower communication hole 282 provided in the lower area of the tub cover 21 and configured to communicate with the connection path 283.

Meanwhile, the tub cover 21 includes an upper surface in which the laundry introduction opening is provided; a cylinder-shaped lateral wall; and a gently curved area 213 gently curved to connect the upper surface and the lateral surface with each other and upwardly inclined towards the center of the tub cover 21.

When the drum 30 is rotated at a high rotation speed after wash water is supplied to the tub 20, the water may rise along an inner surface of the tub 20 by centrifugal force and may move towards the center of the tub cover 21 once meeting the gently curved area 213. Some of the moving wash water may be drawn into the cover groove 285 via the lower communication hole 282.

Meanwhile, the discharging area of the sub-drum 50 may be projected adjacent to an inner surface of the laundry introduction opening as shown in FIG. 8. When the sub-drum 50 accommodating wash water is rotated, the wash water drawn in via the inlet hole is discharged through the outlet hole 79 after passing the chamber 73. At this time, when the sub-drum 50 is rotated at a high rotation speed such as the dry-spinning rpm, the wash water is dispersed from the outlet hole 79 and partially drawn into the cover groove 285 via the lower communication hole 282.

When the lower communication hole 282 is provided adjacent to the laundry introduction opening, the wash water dispersed from the outlet hole 79 may be drawn into the lower communication hole 282. When it is provided adjacent to the gently curved area 213, the wash water rising along the inner surface of the tub 20 is drawn into the lower communication hole 282. In this instance, the lower communication hole 282 may be provided adjacent to the laundry introduction opening of the tub cover 21 to draw a less amount of wash water. That is because the wash water rising along the inner surface of the tub 20 is larger than the wash water dispersed from the outlet hole 79. Accordingly, the lower communication hole 282 may be provided adjacent to the laundry introduction opening of the tub cover 21.

Meanwhile, the connection path 283 may be connected with the lower communication hole 282 and upwardly extended from the lower communication hole 282. An upper end of the connection path 283 is provided for an inlet blocking area to block the connection path 283 and a lateral surface of the connection path 283 is in communication with the upper communication hole 281. Accordingly, the wash water drawn into the connection path 283 via the lower communication hole 282 is collided with the inlet blocking area only to reduce the amount of the water drawn into the cover groove 285. That is because the inlet blocking area gives the drawn in wash water resistance.

In other words, the connection path 283 is extended upwardly and then bent toward the cover groove 285. The bent connection path 283 gives resistance to the wash water flowing along the path to reduce the amount of the wash water drawn into the cover groove 285.

A plurality of such cover discharging units 28 may be provided in the tub cover 21, spaced apart at a preset angle.

Meanwhile, the water supply unit 18 is provided in an upper rear area of the tub cover 21. The water supply unit 18 is provided with wash water from an external water supply source and supplies the wash water to the drum or the sub-drum 50. A hose (not shown) connected with the external water supply source is usually provided in a rear surface of the laundry treating apparatus and the water supply unit 18 is also usually provided in a rear surface of the tub cover 21.

Meanwhile, once the water supply unit 18 starts the water supply, some of the wash water splits to the upper surface of the tub cover 21 and collects to flow along the upper surface of the tub cover 21. There may be a concern that the flowing wash water will be drawn into the sensor unit (e.g., first hall sensor 55) and thus a shut-off rib may be provided to prevent drawing in wash water.

The shut-off rib is configured to shut off or block the water discharged from the water supply unit 18 from being moved toward the sensor unit (e.g., 55 along the tub cover 21. Such shut-off rib shown in FIGS. 8 and 9 may include a lateral direction shut-off rib 211 extended to across along a circumferential direction of the tub cover 21; and a rear direction shut-off rib 212 extended along the circumferential direction of the tub cover 21, which are provided in both sides of the water supply unit 18, respectively.

The lateral direction shut-off rib 211 may block the wash water discharged from the water supply unit 18 from moving towards the sensor unit (e.g., first hall sensor 55) along the circumferential surface of the tub cover 21. The rear direction shut-off rib 212 may guide the discharged wash water towards the laundry introduction opening and block the water from moving towards the lateral direction shut-off rib as much as possible. In addition, the rear direction shut-off rib 212 may also block the wash water from moving out of the tub.

Such shut-off ribs may be provided between the mounting portion 59 and the water supply unit 18 and may be configured to shut off or block the wash water discharged from the water supply unit 18 from being moved towards the sensor unit (e.g., first hall sensor 55).

Meanwhile, the sensor unit (e.g., first hall sensor 55) is provided with electric power from an external power supply source and operated. Accordingly, when the sensor unit (e.g., first hall sensor 55) is located in a rear area of the tub cover 21, it is advantageous to reduce or eliminate wires for electrically connecting the sensor unit and the power supply. In this instance, the water supply unit 18 is also located in the rear area of the tub cover 21 and the sensor unit (e.g., first hall sensor 55) is located in a lateral area of the water supply unit 18. The shut-off rib is located between the water supply unit 18 and the sensor unit (e.g., first hall sensor 55) as described above.

Accordingly, the sensor unit (e.g., first hall sensor 55) may be protected from wash water that may be drawn in via the plurality of ribs and the plurality of cover discharging units.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within their scope as may be defined in the appended claims, and therefore all changes and modifications that fall within the metes and bounds of the claims, or equivalents of such metes and bounds, are therefore intended to be embraced by the claims.

INDUSTRIAL APPLICABILITY

Industrial applicability of the present invention is included in the description of the specific embodiments.

What is claimed is:

1. A laundry treating apparatus configured to be disposed on a reference plane, the laundry treating apparatus comprising:

a tub provided to hold wash water;

a drum rotatably provided in the tub;

a sub-drum detachably mounted to an inner circumferential surface of the drum and configured to wash laundry independent from the drum;

a tub cover provided at an upper end of the tub and comprising a laundry introduction opening formed therein;

a sensing object provided in the sub-drum; and a sensor unit provided in the tub cover and configured to sense the sensing object.

2. The laundry treating apparatus according to claim 1, further comprising:

a mounting portion provided in the tub cover and configured to mount the sensor unit therein, wherein the mounting portion is configured to surround the sensor unit to protect from water being drawn into the sensor unit.

3. The laundry treating apparatus according to claim 2, wherein the mounting portion comprises:

an accommodating area provided in the tub cover and configured to accommodate the sensor unit;

an accommodating area cover configured to selectively close the accommodating area; and a hinge unit configured to rotatably connect the accommodating area cover to the tub cover.

4. The laundry treating apparatus according to claim 3, wherein the mounting portion is integrally injection-molded with the tub cover.

5. The laundry treating apparatus according to claim 4, wherein the hinge unit is formed between the mounting portion and the accommodating area cover, and has a smaller thickness than the accommodating area cover, such that the hinge unit is configured to be foldable.

6. The laundry treating apparatus according to claim 3, wherein the hinge unit is located in an inner area of the mounting portion with respect to a radial direction of the tub cover, and the accommodating area cover is configured to cover the mounting portion when the hinge unit is folded towards an outer area with respect to the radial direction of the tub cover via the hinge unit.

7. The laundry treating apparatus according to claim 3, further comprising:

a fixing unit comprising a cover hook provided in the accommodating area cover; and a hook groove provided in the accommodating area and configured to be coupled to the cover hook, wherein the fixing unit is operable between a first state in which the cover hook and the hook groove are disengaged, and a second state in which the cover hook is inserted in the hook groove and one end of the cover hook is exposed to an outside.

8. The laundry treating apparatus according to claim 7, wherein the accommodating area is partitioned off into a sensor seating area configured to seat the sensor unit therein; and a damping area in communication with the outside via the hook groove.

9. The laundry treating apparatus according to claim 8, wherein the accommodating area comprises:

a blocking protrusion provided in the accommodating area configured to prevent water from flowing between the sensor seating area and the damping area.

10. The laundry treating apparatus according to claim 3, wherein the accommodating area cover comprises:

a pair of support projections configured to support a radial inner end and a radial out end of the sensor unit and to prevent movement of the sensor unit caused by rotation of the sub-drum.

11. The laundry treating apparatus according to claim 1, further comprising:

a cover discharging unit provided in the tub cover and configured to discharge water collected in an upper area of the tub cover to a lower area of the tub cover.

12. The laundry treating apparatus according to claim 1, further comprising:

a water supply unit provided in an upper rear area of the tub cover and configured to supply wash water, wherein the tub cover comprises a shut-off rib configured to block water discharged from the water supply unit from moving towards the sensor unit along the upper area of the tub cover.

13. The laundry treating apparatus according to claim 12, wherein the sensor unit is provided in the upper area of the tub cover, adjacent to the water supply unit.

14. A laundry treating apparatus comprising:

a tub configured to hold wash water;

a drum rotatably provided in the tub;

a sub-drum detachably mounted to an inner circumferential surface of the drum and configured to wash laundry independent from the drum;

a tub cover provided at an upper end of the tub and comprising a laundry introduction opening formed therein;

a magnet unit provided in the sub-drum;

a hall sensor provided in the tub cover and configured to sense the magnet unit; and a mounting portion provided in the tub cover and configured to mount the hall sensor to the tub cover and prevent water from being drawn into the hall sensor.

15. The laundry treating apparatus according to claim 14, wherein the mounting portion comprises:

an accommodating area recessed from the tub cover and configured to accommodate the hall sensor; and a cover unit comprising an accommodating area cover configured to selectively close the accommodating area and a hinge unit configured to rotatably connect the accommodating area cover to the tub cover.

16. The laundry treating apparatus according to claim 15, further comprising:

a fixing unit comprising a cover hook provided in the accommodating area cover; and a hook groove recessed from the accommodating area and configured to be coupled to the cover hook, wherein the hook groove is configured to expose one end of the cover hook when inserted.

17. The laundry treating apparatus according to claim 16, wherein the accommodating area is partitioned off into a sensor seating area configured to seat the hall sensor therein; and a damping area in communication with the outside via the hook groove by a blocking protrusion provided in a lower surface of the accommodating area.

18. The laundry treating apparatus according to claim 15, wherein a thickness of the hinge unit is smaller than a thickness of the accommodating area cover.

19. The laundry treating apparatus according to claim 18, wherein the hinge unit is located in an inner area with respect to a radial direction of the tub cover, and the accommodating area cover is configured to be rotated towards an outer area with respect to the radial direction from the hinge unit to cover the accommodating area.

20. The laundry treating apparatus according to claim 1, further comprising:

a water supply unit provided in an upper rear area of the tub cover and configured to supply wash water, wherein the tub cover comprises:

a shut-off rib configured to shut off water discharged from the water supply unit from being moved towards the sensor unit along an upper area of the tub cover; and a plurality of cover discharging units provided in the upper area of the tub cover along a circumferential direction and configured to discharge water collected in the upper area of the tub cover to a lower area of the tub cover, and wherein the sensor unit is located between the shut-off rib and a cover discharging unit of the plurality of cover discharging units.

* * * * *